US006198476B1

(12) United States Patent
Hong et al.

(10) Patent No.: US 6,198,476 B1
(45) Date of Patent: Mar. 6, 2001

(54) METHOD OF AND SYSTEM FOR DRIVING AC PLASMA DISPLAY PANEL

(75) Inventors: Jin-Won Hong; Eun-Cheol Lee; Sang-Jin Yun; Young-Bok Song; Jae-Hyuck Lee; Bong-Koo Kang; Young-Hwan Kim; Dae-Ki Ahn, all of Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 08/968,942

(22) Filed: Nov. 12, 1997

(30) Foreign Application Priority Data

Nov. 12, 1996 (KR) ..... 96-53406
Nov. 12, 1996 (KR) ..... 96-53407
Nov. 26, 1996 (KR) ..... 96-57317
Nov. 26, 1996 (KR) ..... 96-57320

(51) Int. Cl.[7] ..... G09G 5/00
(52) U.S. Cl. ..... 345/204; 315/169.4
(58) Field of Search ..... 345/60, 61, 63, 345/204, 147, 103, 89

(56) References Cited

U.S. PATENT DOCUMENTS 4,130,777 * 12/1978 De Jule ..... 315/169 TV
4,190,789 * 2/1980 Kawada et al. ..... 315/169.4
4,426,646 * 1/1984 Yamaguchi et al. ..... 340/769
5,376,944 * 12/1994 Mogi et al. ..... 345/100
5,442,396 * 8/1995 Nakashiba ..... 348/322
5,745,086 * 4/1998 Weber ..... 345/63
5,841,413 * 11/1998 Zhu et al. ..... 345/63
5,874,932 * 2/1999 Nagaoka et al. ..... 345/60

* cited by examiner

*Primary Examiner*—Vijay Shankar
*Assistant Examiner*—Vanel Frenel
(74) *Attorney, Agent, or Firm*—Finnegan, Henderson, Farabow, Garrett, & Dunner, L.L.P.

(57) ABSTRACT

A method of and system for driving a plasma display panel (PDP), which is designed to increase the amount of data processed in unit time. The method includes the steps of dividing row electrodes into at least two groups, splitting the field, and applying driving pulses to each split field with a phase difference. Also, the present invention uses a lower bit preceding scanning method where the bits of a digital picture signal are aggregated by bits of a kind from the most significant bit to the least significant bit and divided into a plurality of pairs of upper and lower bits as (lower bit, upper bit), the lower bit in each pair of bits being successively scanned, followed by a scanning of the upper bit in each pair of bits. Thus, the efficiency of the AC PDP is enhanced with the reduction in the time needed to construct the field, and readily driving a field even when the amount of data to be scanned is increased.

28 Claims, 26 Drawing Sheets

BASIC DRIVING WAVEFORM FOR S-C ELECTRODES

BASIC DRIVING WAVEFORM FOR S'-C' ELECTRODES

<INITIAL STATE= ON>

<INITIAL STATE= ON>

METHOD OF AND SYSTEM FOR DRIVING AC PLASMA DISPLAY PANEL

BACKGROUND OF THE INVENTION

A. Field of the Invention

The present invention relates to a method of and system for driving a PDP (Plasma Display Panel) and, more particularly, to a method of and system for driving a PDP which is designed to increase the amount of data processed in unit time.

B. Description of Prior Art

In general, a PDP performs an electric discharge by regulating the voltages applied between the vertical and horizontal electrodes of cells that constitute a pixel, and the amount of light discharged can be controlled by varying the period of time for performing a discharge in the cell.

A picture is formed when the vertical and horizontal electrodes of each cell receive a write pulse for feeding digital picture signals, a scan pulse for performing a scan, a sustain pulse for sustaining a discharge, and an erase pulse for suspending the discharge of the cell being discharged, wherein the pulses are driven in the matrix form.

Grey level by steps that is needed to display the whole picture can be realized by varying the period of time for performing a discharge of each cell in a predetermined time required to display the whole picture (i.e., 1/30 seconds for the NTSC mode TV signals).

The luminance of a picture is dependent on the grey level at the time that each cell is driven to the maximum. To increase the luminance, the driving circuit has to be designed to sustain the time required for a discharge in the cell within a required time to display the picture to the utmost.

The contrast, which is the degree of difference between the lightest and darkest parts of a picture, is dependent on the grey level and luminance of the background lighting. To increase the contrast, the background has to be dark with the increase of the luminance.

The flat panel display of an HD TV needs 256 grey levels, the resolution of more than 1280×1024, and the contrast of above 100:1 under background luminance of 200 lux luminance.

To display a picture with 256 grey levels, each of digital RGB picture signals has to be an 8-bit signal. The period of time for performing a discharge in each cell must be sustained to the utmost in order to reach the required luminance and contrast.

Line scanning or subfield scanning is used as a method of realizing grey levels. For PDP applications, the subfield scanning has received most attention lately.

In the subfield scanning, 8-bit picture signals are gathered in groups of the same weight bits, from the MSB (Most Significant Bit) to the LSB (Least Significant Bit). The most significant bit is scanned for time T and the lower bits are each scanned for $$\frac{T}{2}, \frac{T}{4}, \ldots, \frac{T}{128}$$

in order of vicinity to the MSB, so that subfields are formed. 256 grey levels are then realized by using the eyes' integration effect for the lights emitted from the respective subfields.

However, the PDPs, which must be driven in a matrix format, has a disadvantage in that the write pulses cannot be applied to two or more horizontal electrodes at a time with respect to a given vertical electrode, and the horizontal electrodes have to be driven at different times.

Thus, the time required for scanning all horizontal electrodes is needed in forming each subfield so that each cell is kept discharged only for the time shortened by the time required for a scanning from an average time for scanning the respective subfields.

Further, a discharge cannot be sustained during the scanning time that increases with the number of horizontal electrodes, thus deteriorating the luminance and contrast of the PDP. Thus, the scanning time must be as short as possible.

Since the difference between the periods of a discharge of the upper and lower bits is great and the subfields are sequentially constructed, a flicker phenomenon occurs much. To avoid the flicker phenomenon, it is needed to construct the upper bit subfields, taking much time for a discharge, and the lower bit subfields taking a short time for a discharge in appropriate order.

FIG. 1 illustrates a cell structure of a three-electrode surface discharge AC PDP that is widely used now.

As shown in FIG. 1, lower and upper insulating plates 1 and 2 are supported in parallel by separation walls 10 for separating the cells. Row electrodes 3 having one scan electrode and one common electrodes are arranged in parallel with one another on the lower insulating plate 1.

Column electrodes 4 arranged in parallel with one another under the upper insulating plate 2 form a matrix with the row electrodes 3.

Lower and upper insulating layers 5 and 6 cover the row electrodes 3 and the column electrodes 4, respectively, for the protection purpose, so that a discharge driven by the DC voltage applied between the electrodes becomes extinct immediately.

To sustain a discharge in an AC PDP with the electrode structure as described above, an AC voltage which is successively inverted in the polarity has to be applied between the electrodes.

Protection layer 7 is formed on the lower insulating layer 5 and is made from MgO thin films, thus prolonging the life of the insulating layer 5, enhancing the emission efficiency of secondary electrons, and preventing the change in the discharge characteristic that might be caused by oxide contaminants of ignited metals.

Phosphor 9 is formed on the upper insulating layer 6 and excited by ultraviolet rays emitted during an electric discharge, emitting red, green and blue visible rays.

Discharge space 8, a space for an electric discharge in the cell is usually filled with mixed gases of Ar and Xe in order to enhance the efficiency of the ultraviolet ray emission.

FIG. 2 shows the electrode arrangement of a general three-electrode surface discharge AC PDP.

As shown in FIG. 2, each cell 11 is positioned at an intersection of the row and column electrodes. The row electrodes has a group of scan electrodes $S_1$ to $S_m$ for scanning a field, and a group of common electrodes $C_1$ to $C_m$ for sustaining an electric discharge. The column electrodes are generally used to apply data.

Sealing region 12 maintaining the vacuum state inside the PDP is defined by the separation walls formed between the insulating plates 1 and 2, thus closing and securing the PDP's edges with a sealing material.

FIG. 3 is a waveform diagram of driving pulses that are used in a general three-electrode surface discharge AC PDP.

As shown in FIG. 3, a sustain pulse A for sustaining a discharge of the cell is applied to the common electrodes $C_1$ to $C_m$, while another sustain pulse B that is same in the form as the pulse of the common electrode but different in position from it is applied to the scan electrodes $S_1$ to $S_m$.

Each of the scan electrodes $S_1$ to $S_m$ also receives scan pulses for scanning a field and erase pulses for suspending a discharge of the discharged cell, thus controlling the switching operation of the cell.

Column electrodes $D_1$ to $D_m$ receive data pulses synchronized with the scan pulses applied to the scan electrodes, generating write pulses. When data pulses of the positive (+) polarity is applied to the electrode $D_1$ and scan pulses in synchronization with the data pulse are transferred to the cell $S_1$, the voltage between the electrodes $S_1$ and $D_1$ exceeds the threshold voltage that causes an electric discharge in the cell.

Such a discharge will be sustained until the next erase pulse by the electric field formed from the particles that are electrically discharged in the insulating layers during the discharge and by the electric field formed by the sustain pulses of electrodes $S_1$ and $C_1$. If the amplitude of the erase pulse is smaller than that of the sustain pulse, an electric discharge occurs a little to such a degree that the sum of the electric fields caused by the charged particles and the erase pulse cannot sustain the discharge.

To summarize the functions of the respective electrodes described above, the scan electrodes are used to sustain an electric discharge and scan a field, while the common electrodes can only sustain a discharge. The data electrodes are in charge of receiving data for constructing a field.

FIG. 4 is a waveform diagram of driving pulses according to the prior art, showing the voltage between the scan and common electrodes when the waveforms in FIG. 3 are applied to the cell electrodes.

The waveforms shown in FIG. 4 can be obtained by combining the inverted waveforms of the scan electrodes, based on the waveforms of the common electrodes.

This basic driving waveform is characterized in that the scan pulse can be applied in half a period of the sustain pulse because it appears once in a period of the sustain pulse.

FIG. 5 illustrates a scanning based on the conventional subfield driving method of realizing 256 grey levels.

A field is composed of 8 subfields each of which has a constant subfield time $T_A$. The time $T_{FIELD}$ that is needed to construct a field amounts to $8T_A$. The time used to perform a discharge out of the subfield time $T_A$ is determined as $$T_A, \frac{T_A}{2}, \frac{T_A}{4}, \frac{T_A}{8}, \frac{T_A}{16}, \frac{T_A}{32}, \frac{T_A}{64}, \text{ and } \frac{T_A}{128}$$

in order from the MSB to the LSB. Thus the time $T_S$ that is available to a discharge of the time $8T_A$ for constructing a field will be $2T_A$. The time $T_{NS}$ that cannot be used to perform a discharge is $6T_A$.

$$\frac{T_{NS}}{T_{FIELD}} \times 100 = \frac{6}{8} \times 100 = 75\%$$

The percentage of waste time $T_{NS}$ is 75%, calculated as The efficiency is calculated as $$\frac{T_S}{T_{FIELD}} \times 100 = \frac{2}{8} \times 100 = 25\%$$

These values show us that the time that can be used for a discharge is actually not more than 25% of the total time in an AC PDP using the subfield driving method, so that the luminance is greatly deteriorated.

SUMMARY OF THE INVENTION

Accordingly, the present invention is directed to a method of and system for driving a PDP that substantially obviates one or more of the problems due to limitations and disadvantages of the related art.

An object of the present invention is to increase the scanning speed by several times with respect to the prior art.

Another object of the present invention is to reduce the time required for scanning the whole field by dividing row electrodes into at least two groups, splitting the field, and applying driving pulses to each split field with a phase difference.

A further object of the present invention is to provide a subfield scanning method that minimizes the waste time that is not used for a discharge, thus enhancing the efficiency of the PDP and increasing the luminance.

Still another object of the present invention is to provide a method of scanning the field to reduce a flicker phenomenon caused by the difference between discharging times by enhancing the efficiency of the PDP and increasing the luminance with the reduction in the time needed to construct the file.

For the purpose of the object, the present invention uses a lower bit preceding scanning method where the bits of a digital picture signal are aggregated by bits of a kind from the most significant bit to the least significant bit and divided into a plurality of pairs of upper and lower bits as (lower bit, upper bit), the lower bit in each pair of bits being successively scanned, followed by a scanning of the upper bit in each pair of bits. Compared to the conventional subfield driving method, the luminance of the field can be increased. The upper bits taking much time for a discharge and the lower bits having a short discharging time forms pairs of bits and they are successively scanned, reducing a flicker phenomenon due to the difference between the discharging times.

The present invention, as embodied and broadly defined herein, divides the row electrodes of the panel into several groups and applies scan signals having phases different from one group to another.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention:

Figure 13:
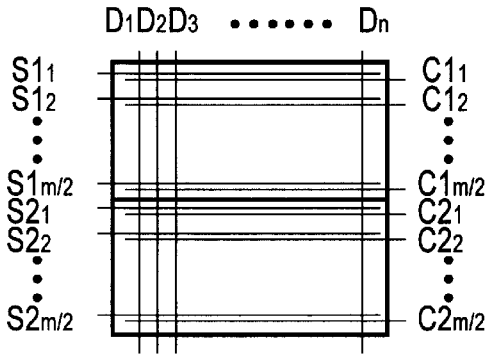
Figure 13:
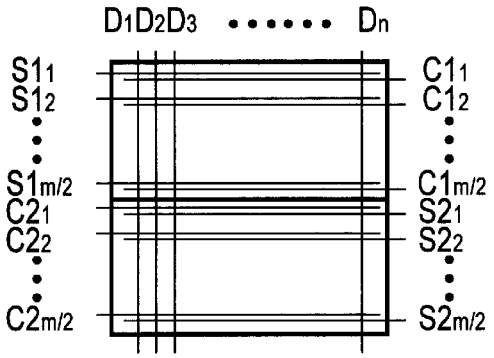
Figure 13:
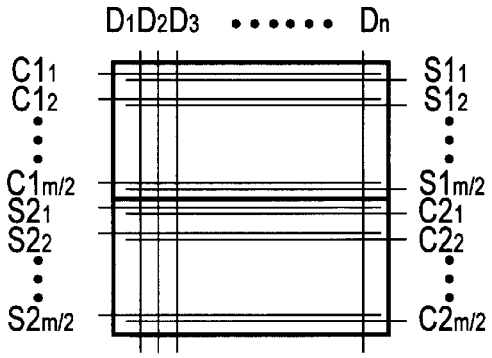
Figure 13:
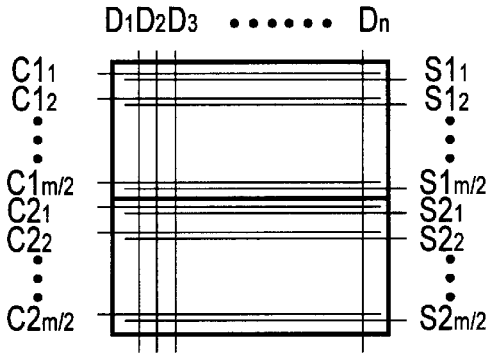
Figure 14:
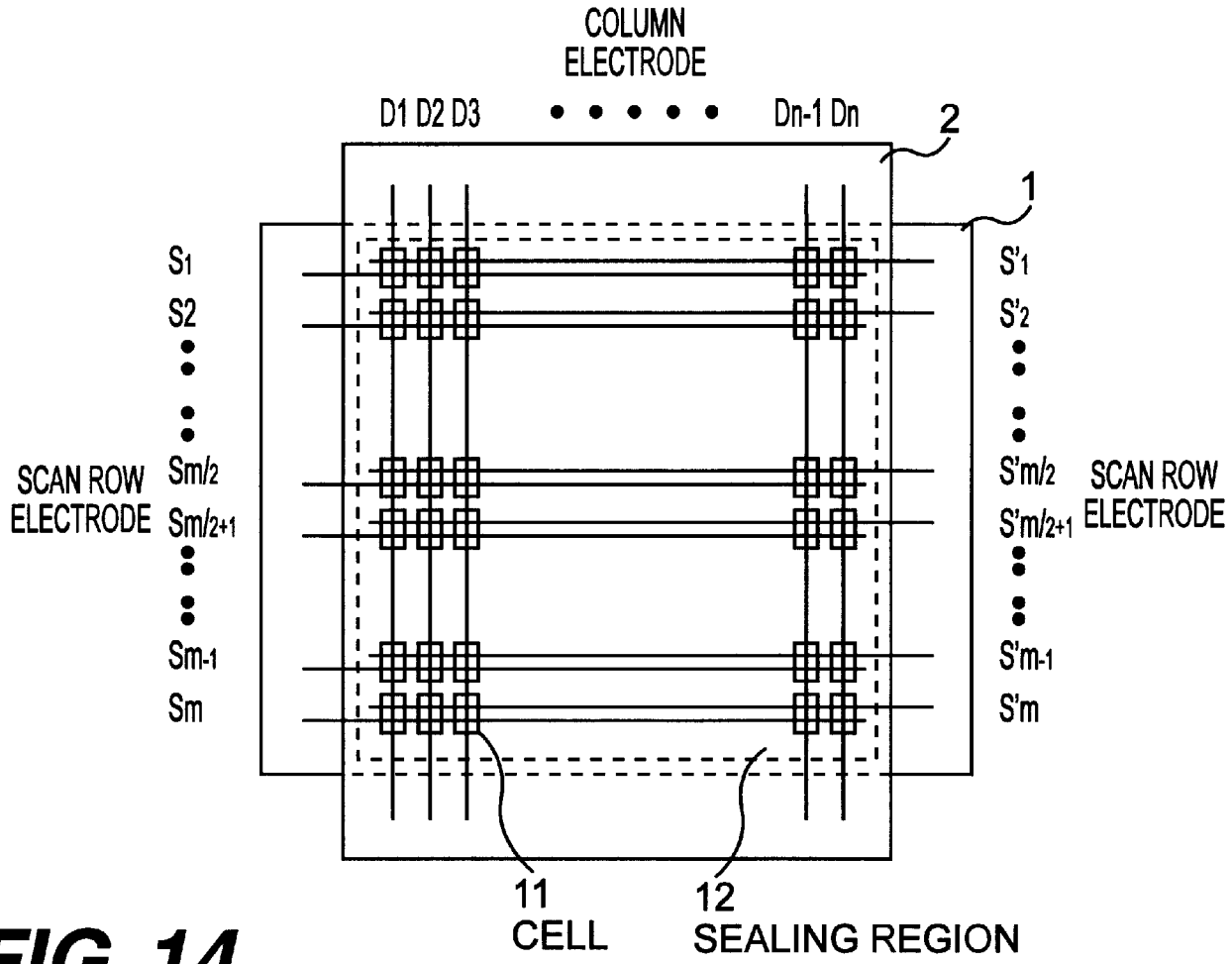
Figure 15:
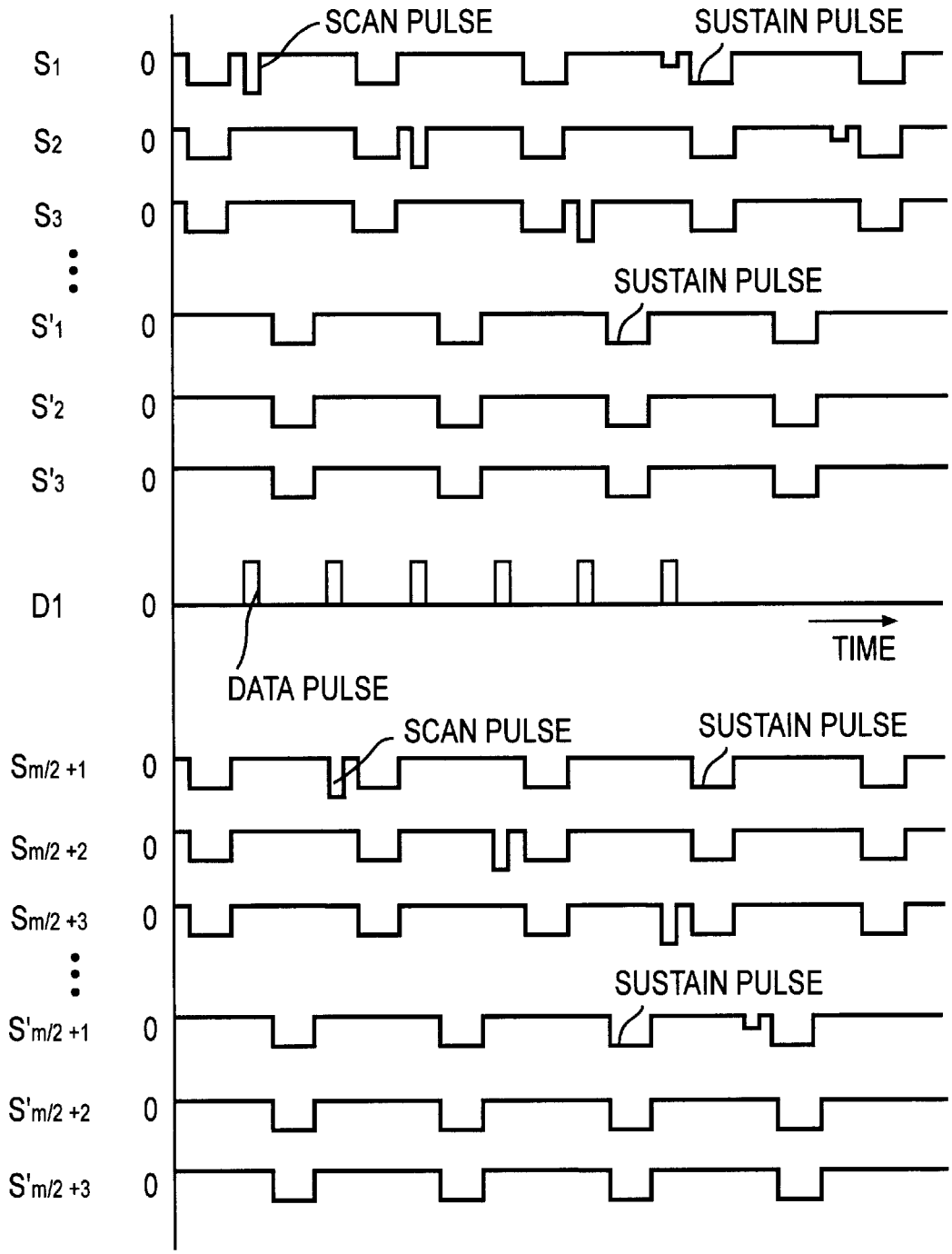
Figure 16:
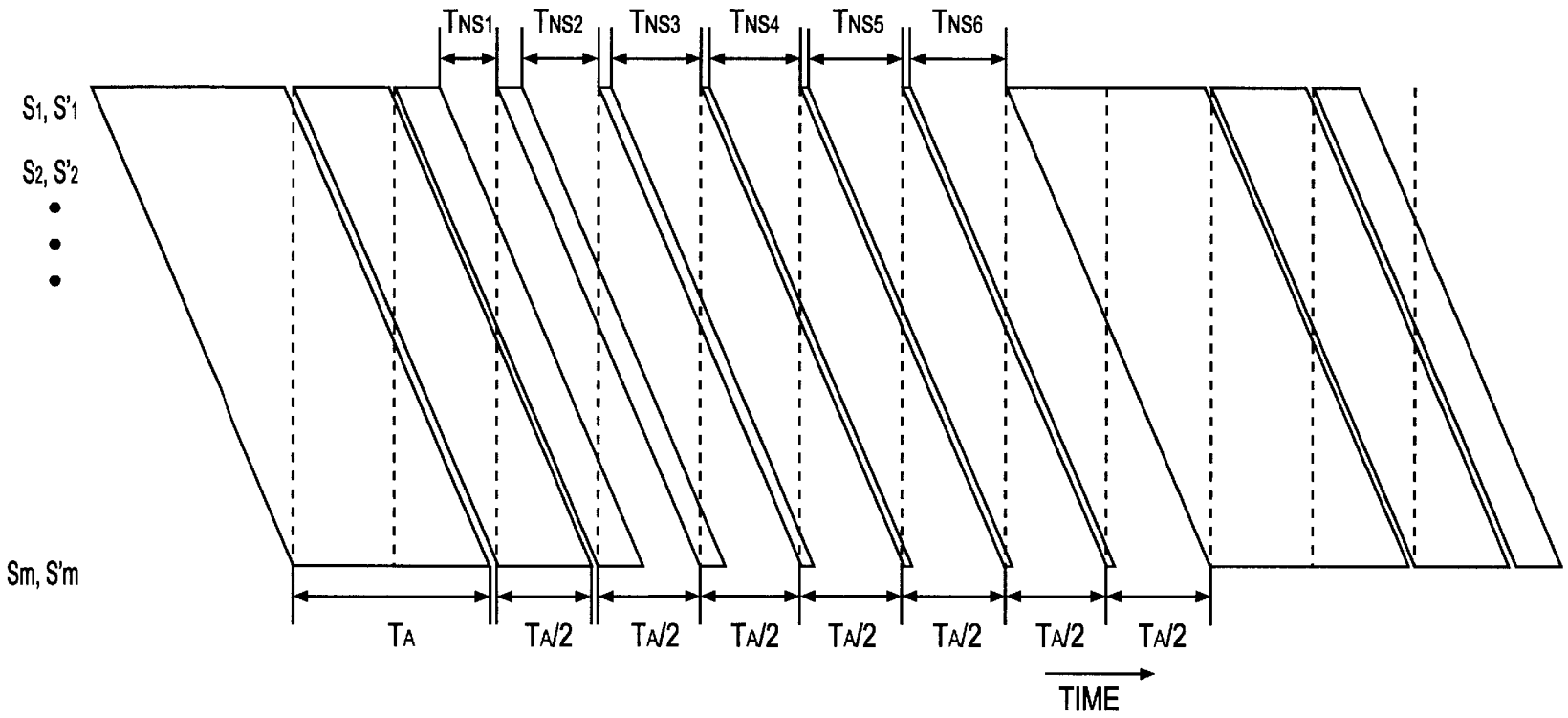
Figure 17:
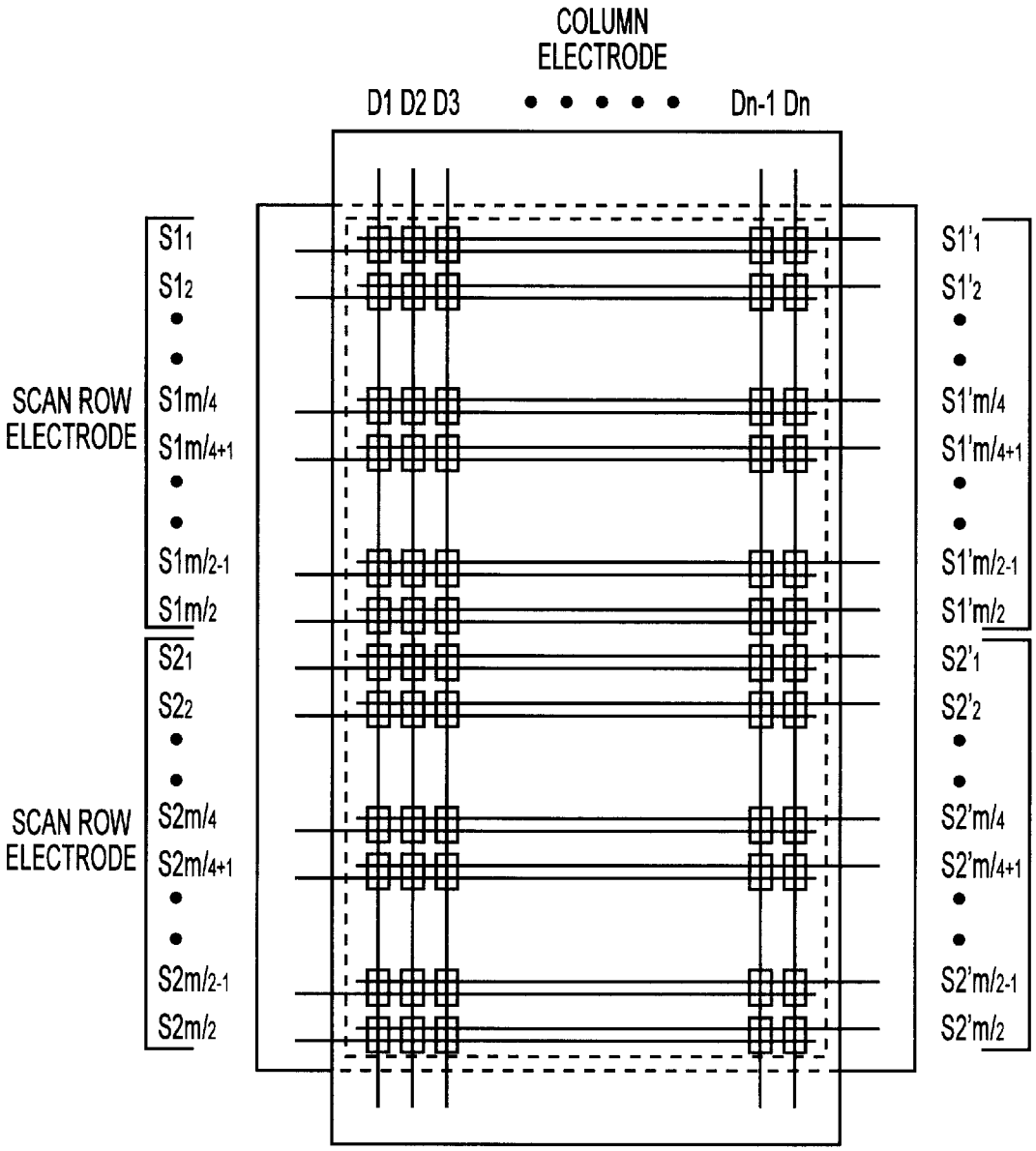
Figure 18A:
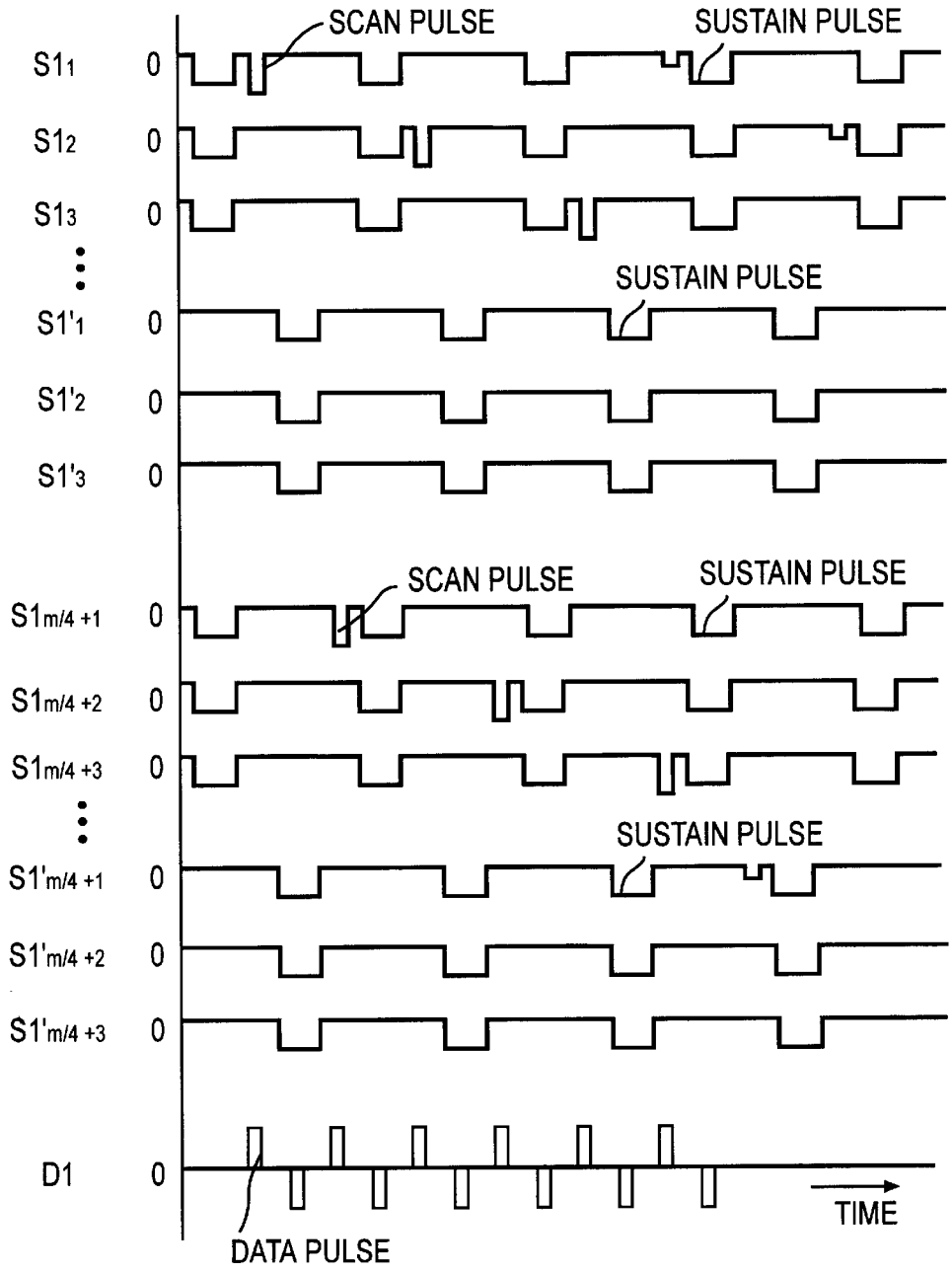
Figure 18B:
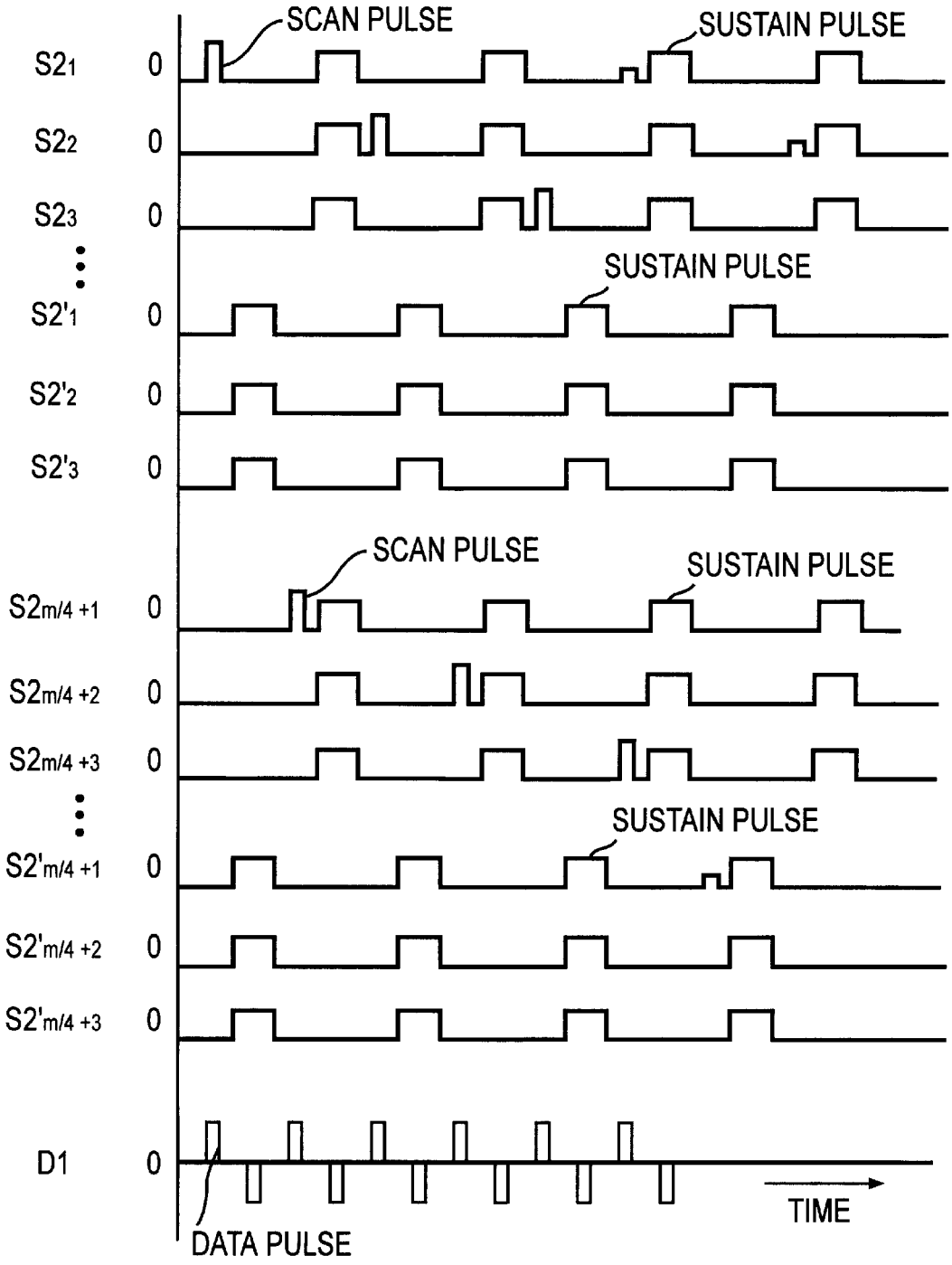
Figure 19:
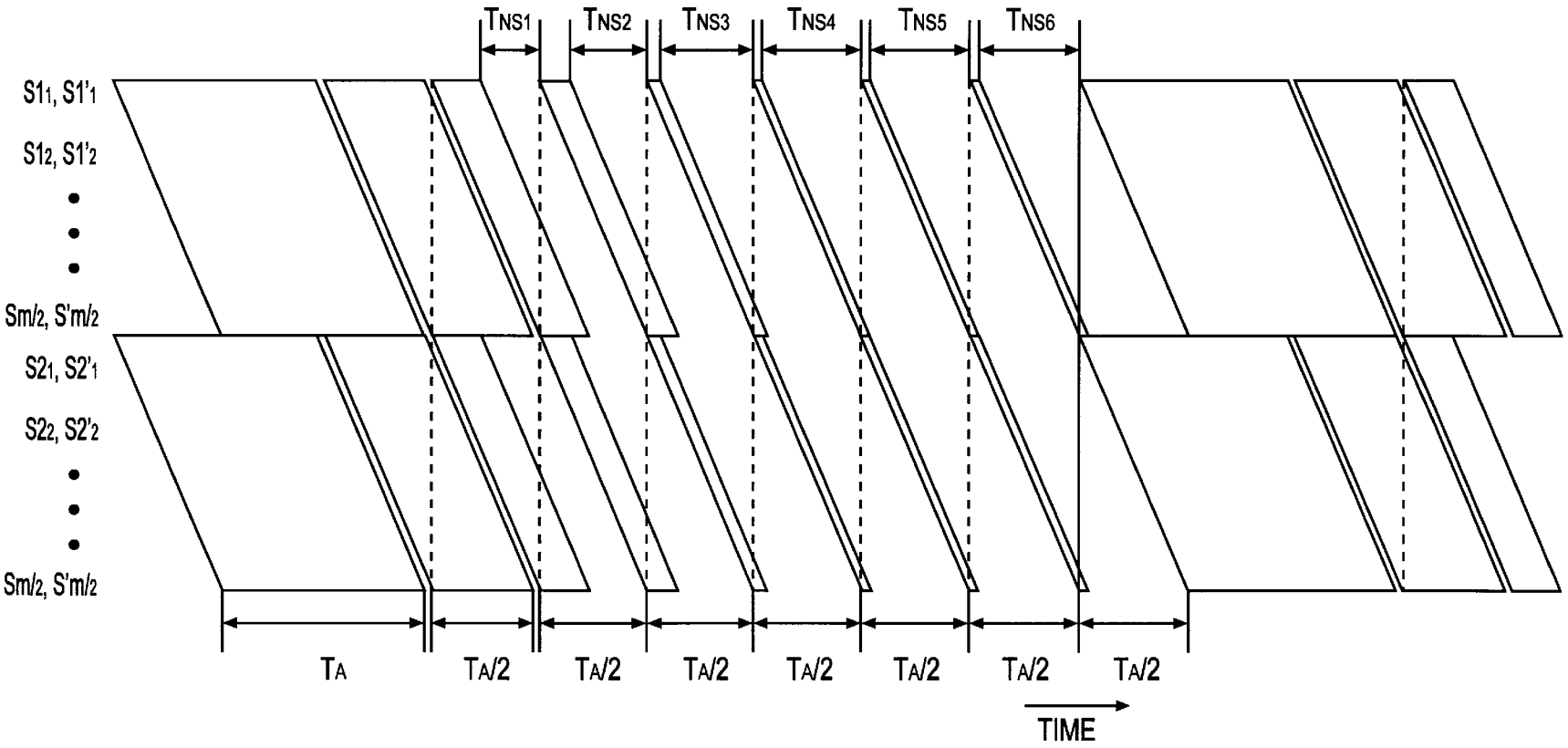
Figure 20:
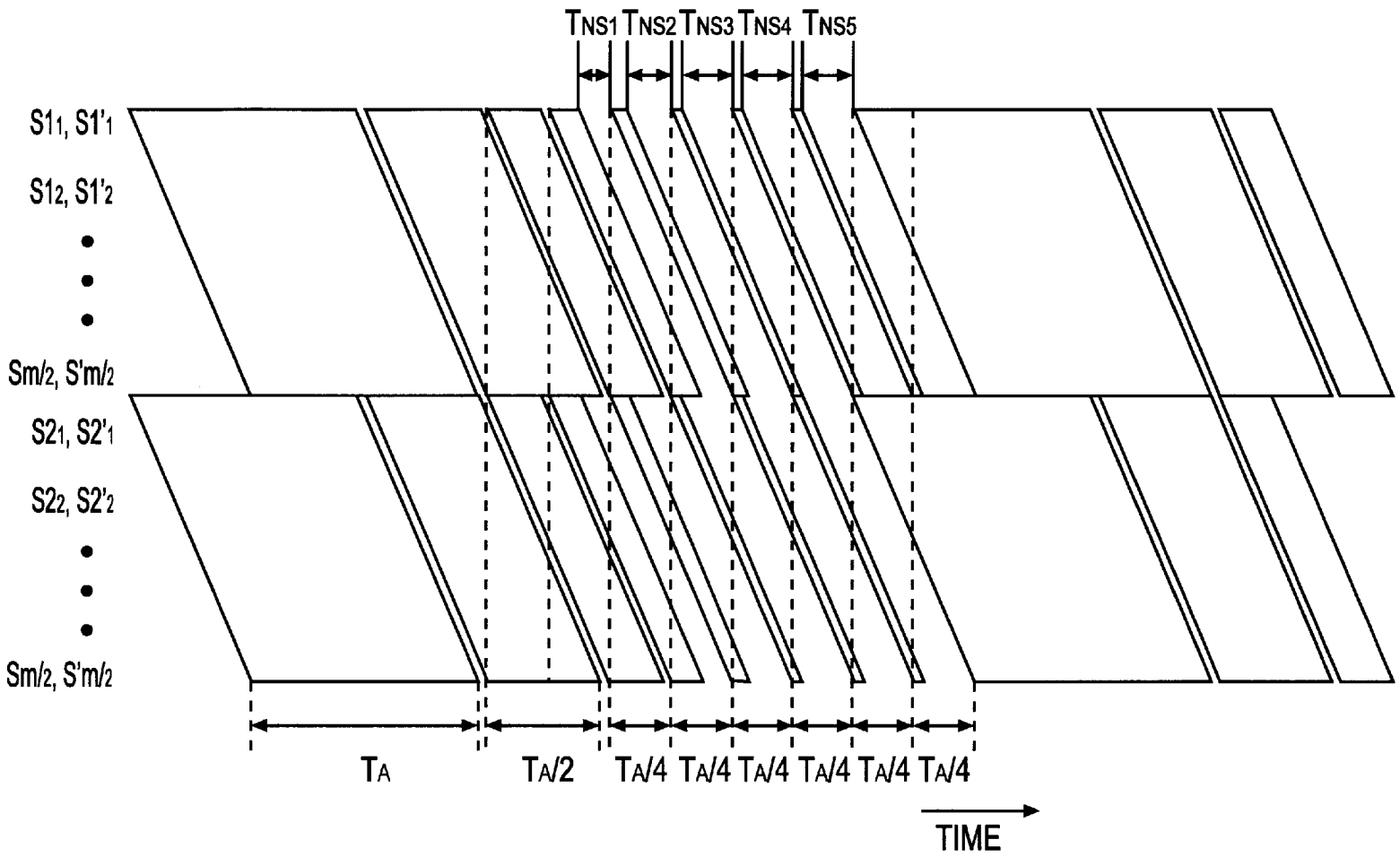
Figure 21:
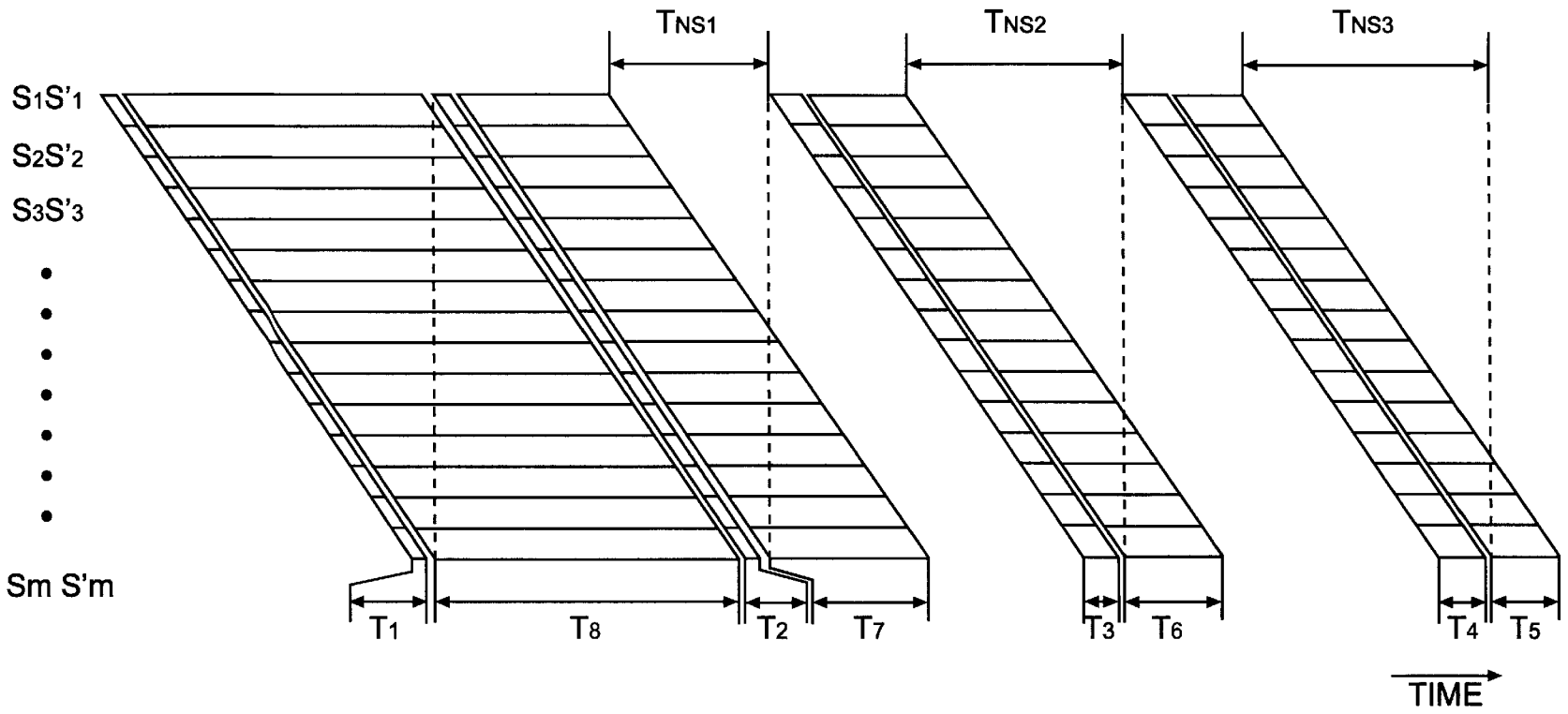
Figure 22:
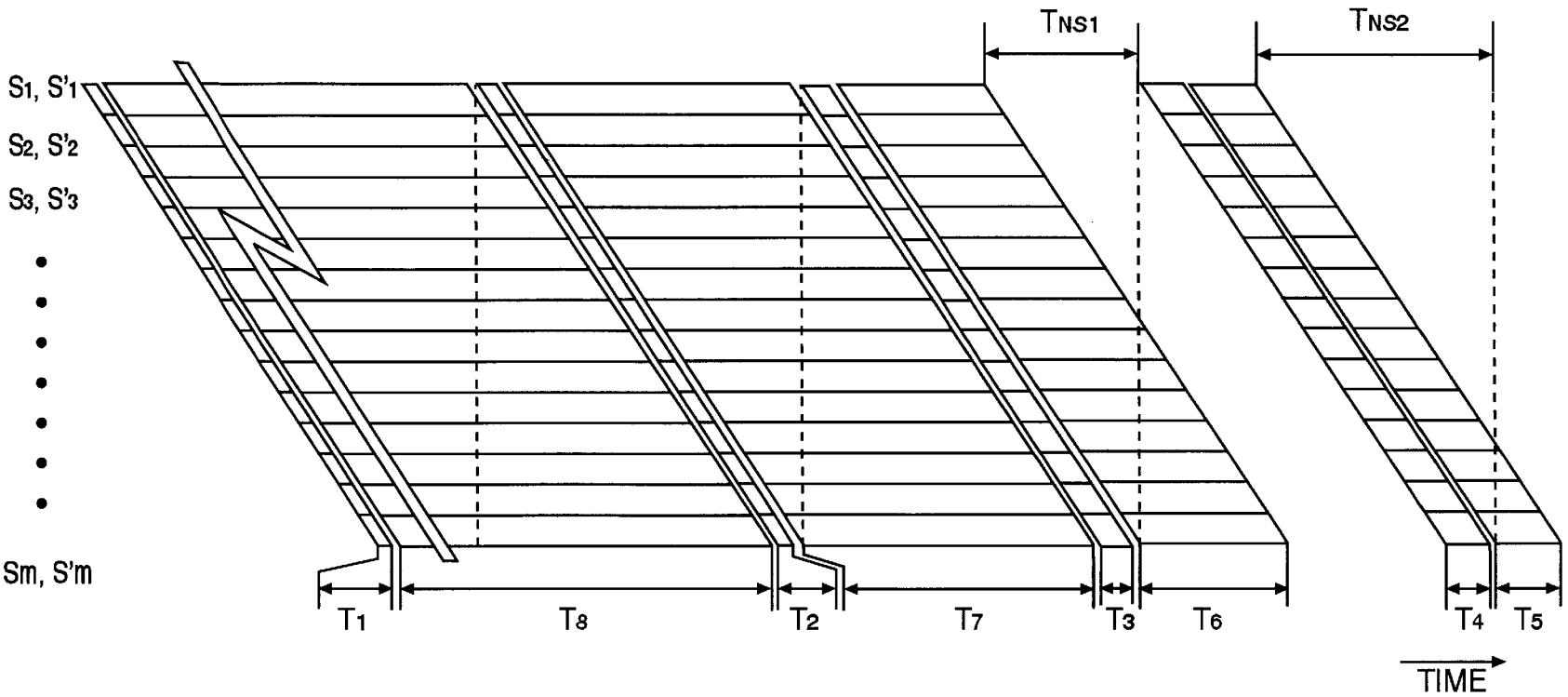
Figure 23:
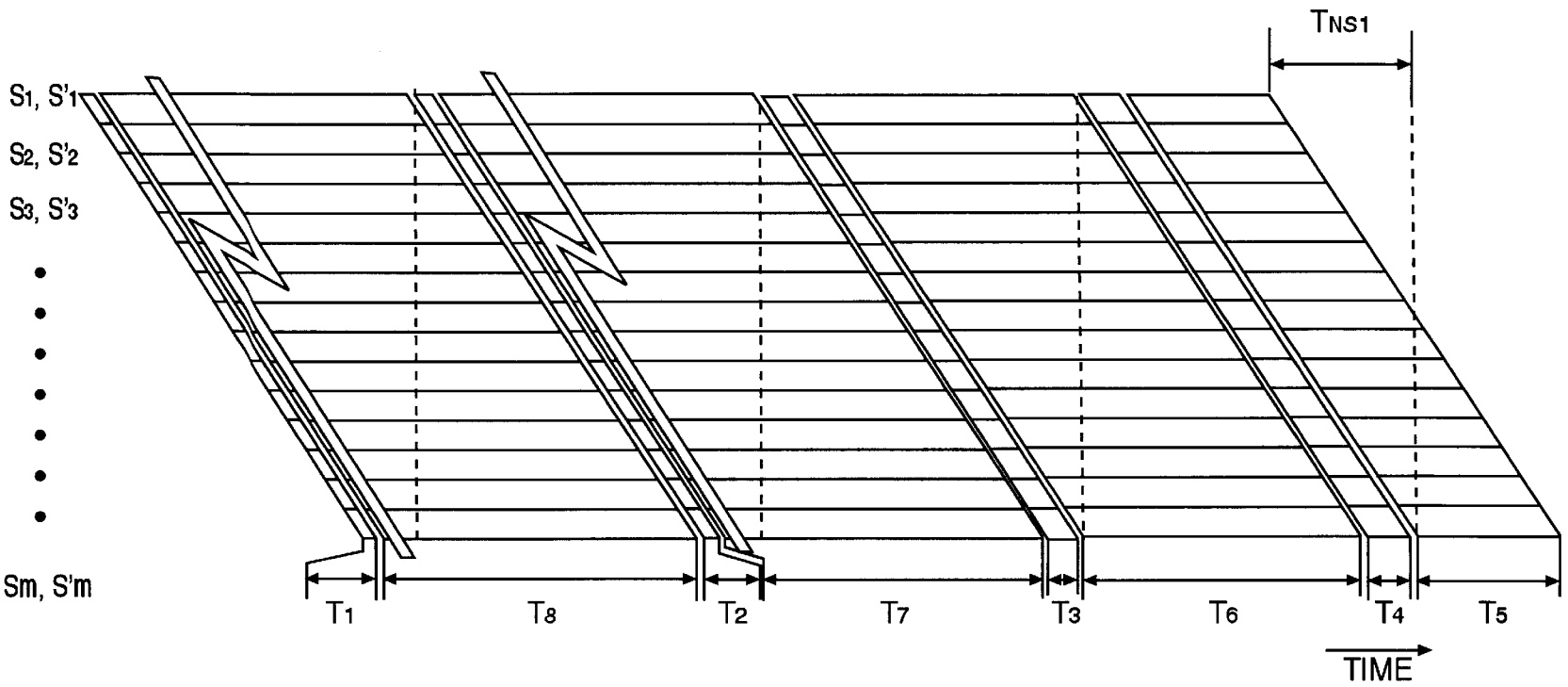
Figure 24:
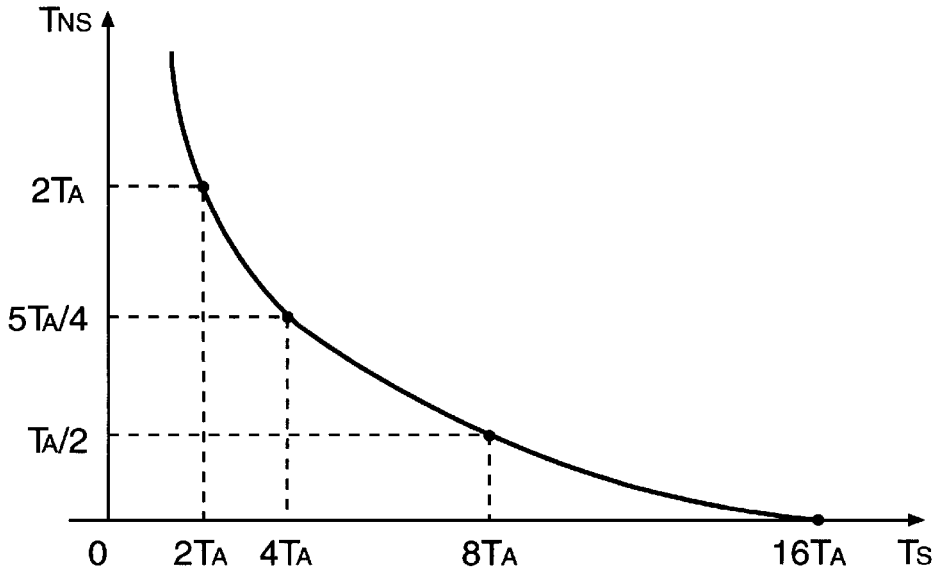
Figure 25:
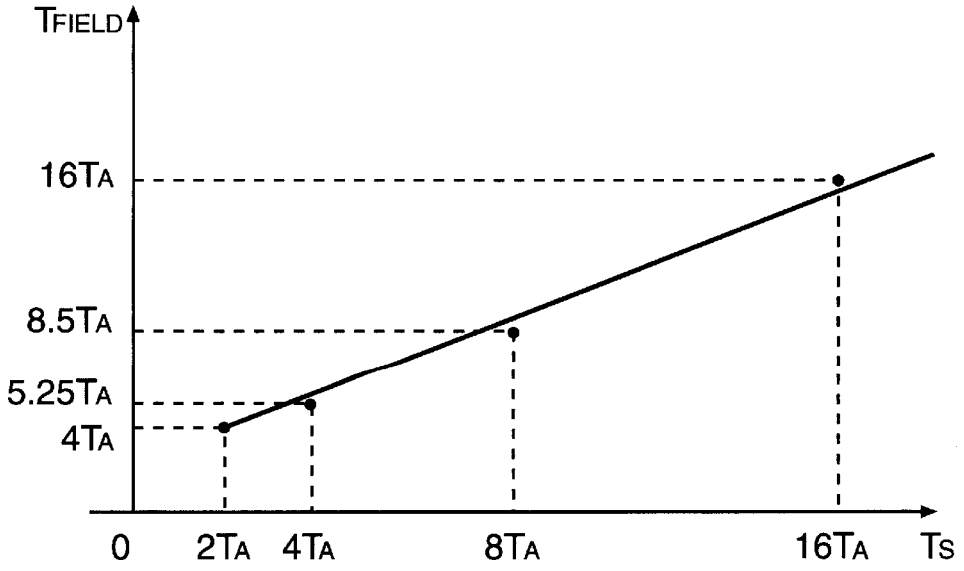
Figure 26:
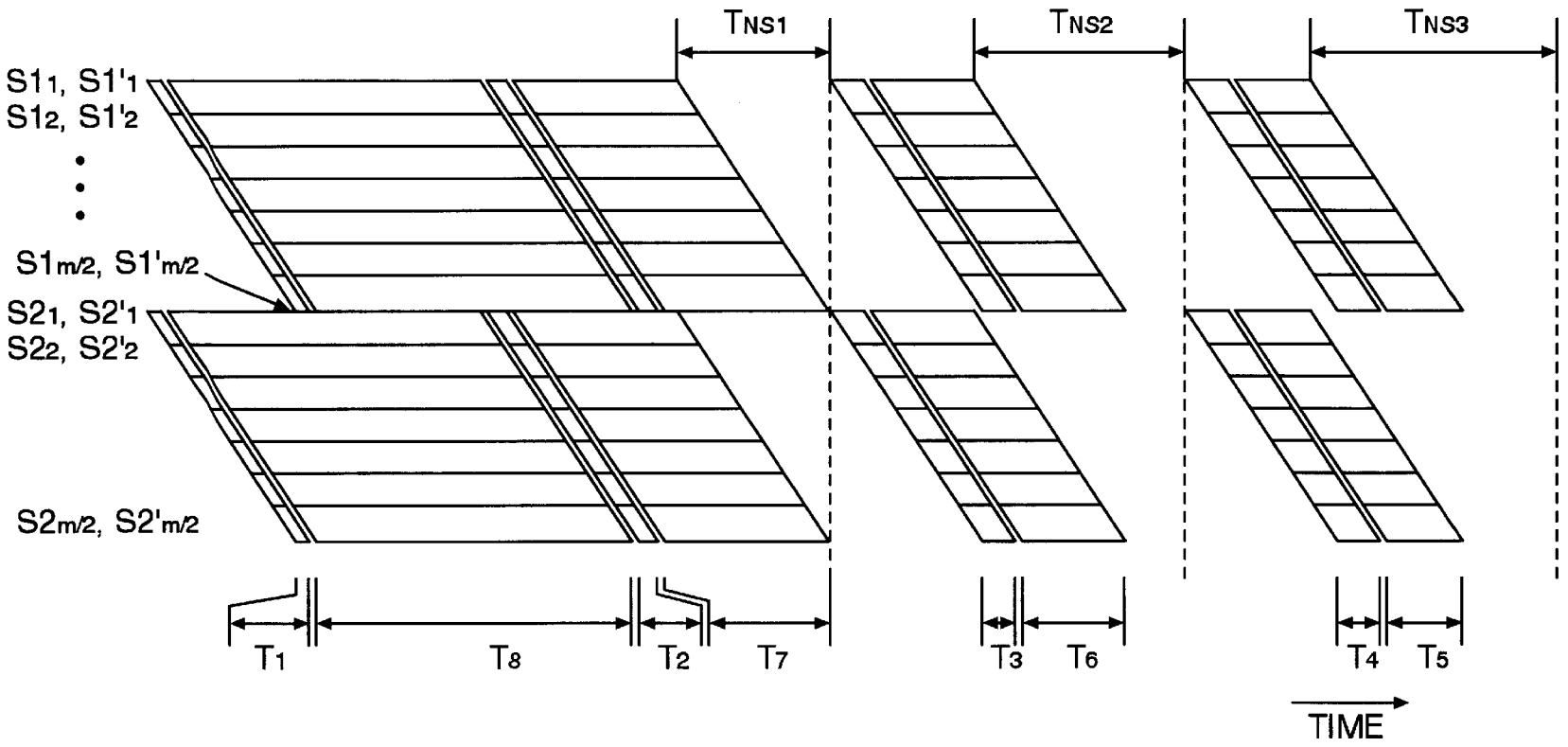
Figure 27:
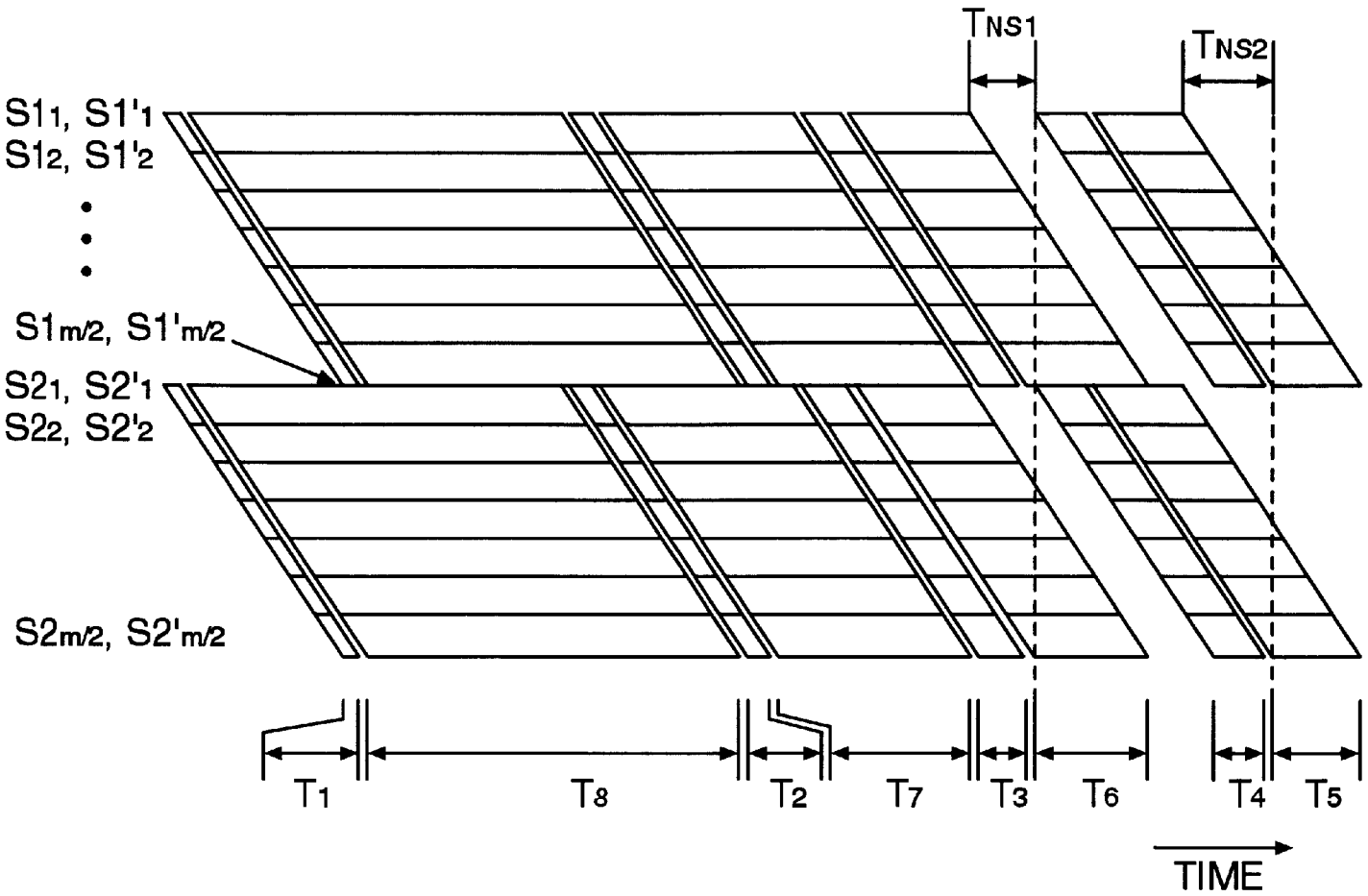

FIGS. 13A–D are schematics of an AC PDP electrode arrangement capable of using a phase differentiation of data and scan pulses, where the electrodes in the upper and lower parts of a picture are arranged in order of {(S1,C1),S2,C2} in FIG. 13A, {(S1,C1),C2,S2} in FIG. 13B, {(C1,S1),S2, C2} in FIG. 13C, and {(C1,S1),C2,S2} in FIG. 13A;

FIG. 14 is a basic electrode arrangement to realize a subfield scanning method for driving even and odd bits separately;

FIG. 15 is a basic waveform diagram of driving pulses to realize a subfield scanning method for driving even and odd bits separately;

FIG. 16 illustrates a field subfield scanning method using the electrode arrangement in FIG. 14;

FIG. 17 is an electrode arrangement to realize a subfield scanning method for driving even and odd bits separately;

FIGS. 18A and 18B are basic waveform diagram of driving pulses to adopt a subfield scanning method, where even and odd bits are separately driven, in a field bisection driving method;

FIG. 19 illustrates a subfield scanning method, dividing FIG. 16 into two parts;

FIG. 20 illustrates an optimized subfield scanning method by using the method in FIG. 16 in FIG. 19;

FIG. 21 illustrates a first scanning method using the lower bit preceding scanning method;

FIG. 22 illustrates a second scanning method using the lower bit preceding scanning method;

FIG. 23 illustrates a third scanning method using the lower bit preceding scanning method;

FIG. 24 shows the variations of $T_{NS}$, the time that cannot be used for a discharge, with respect to the total time $T_S$ that is available for a discharge in the lower bit preceding method;

FIG. 25 shows the variations of $T_{FIELD}$, the time needed to construct a field, with respect to the total time $T_S$ that is available for a discharge in the lower bit preceding method;

FIG. 26 illustrates FIG. 21 whose two parts divided are overlapped with each other in order to realize a field split driving method;

FIG. 27 illustrates a scanning method where the waste time is excluded; and

Figure 28:
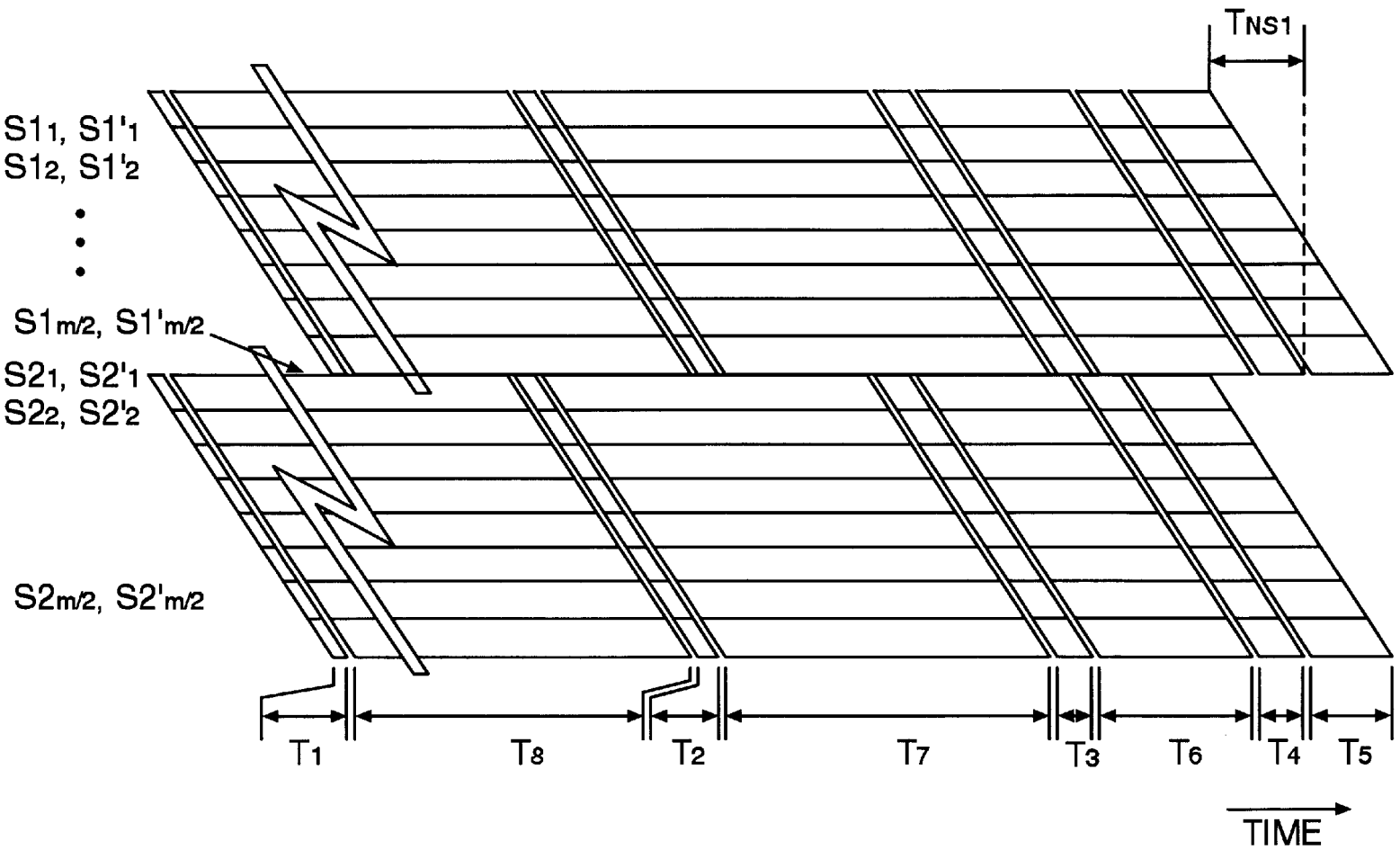

FIG. 28 illustrates a scanning method after FIG. 22 is adopted in the electrode arrangement in FIG. 17.

DETAILED DESCRIPTION OF PREFERRED EMBODIMENT

Reference will now be made in detail to the preferred embodiments of the present invention, examples of which are illustrated in the accompanying drawings.

Figure 7:
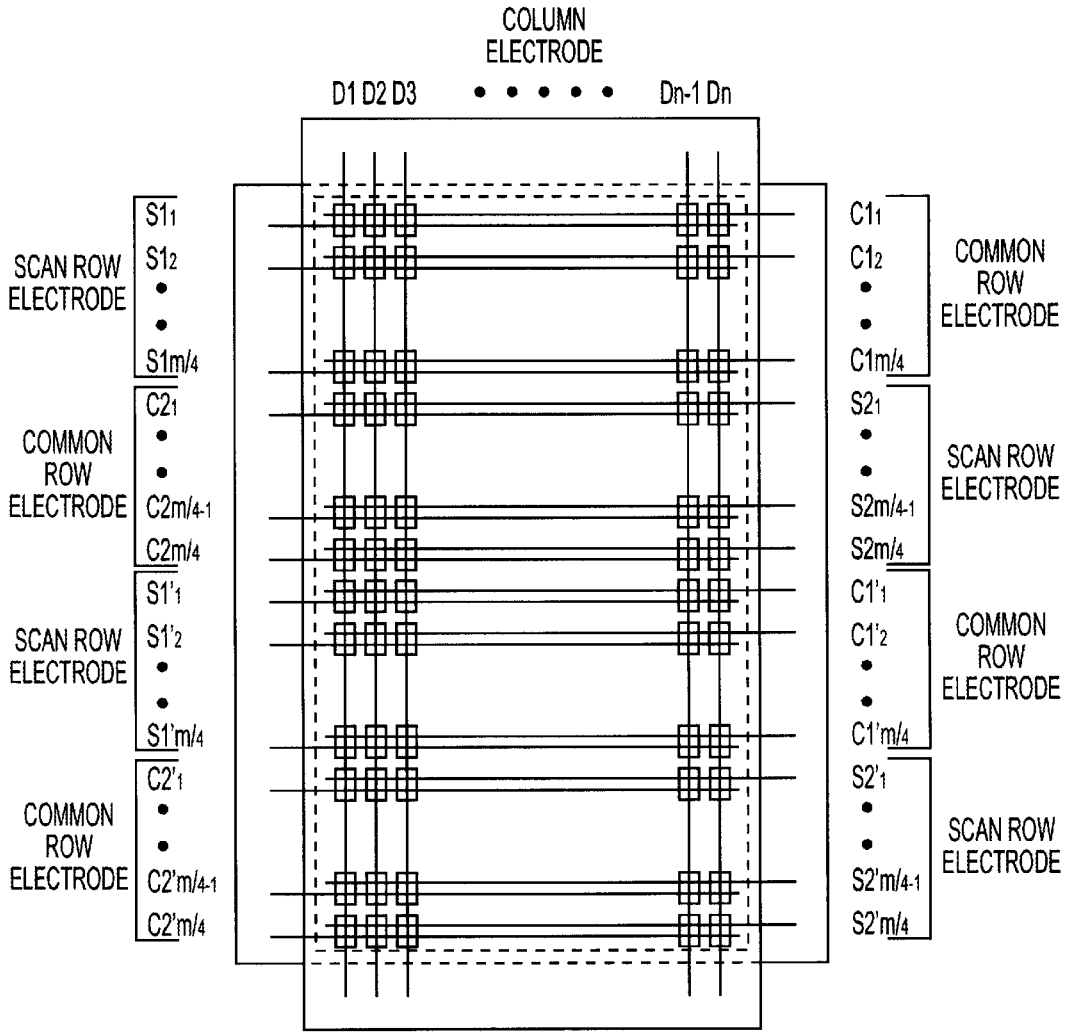
FIG. 7 illustrates an electrode arrangement and voltage polarities to realize a data and scan pulse four-division phase differentiation method according to the present invention.
Figure 8:
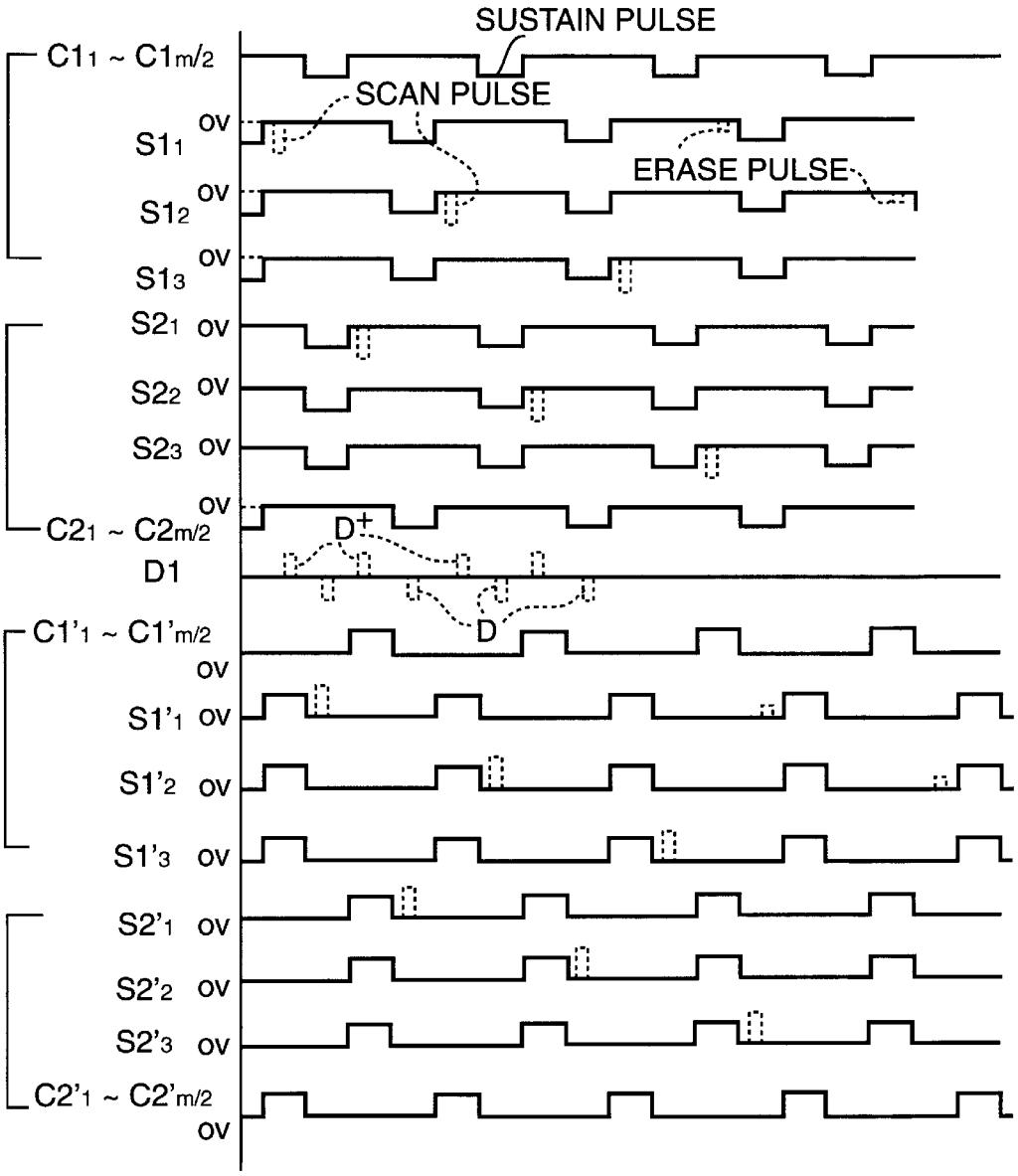
FIG. 8 is a waveform diagram of driving waveforms, in which data is applied to the sustain pulse, according to the present invention.

The electrode arrangement and driving waveforms to realize the objectives of the present invention are respectively illustrated in FIGS. 7 and 8.

Row electrodes are divided into at least two groups, splitting a field, and driving pulses having a predetermined phase difference are applied to each split field, so that the time needed to scan the whole field can be reduced.

As seen from the electrode arrangement in FIG. 7, the whole panel is largely divided into upper and lower fields. The electrodes in the upper field are indicated as S and C, and those in the lower field are expressed by S' and C'.

Electrodes C and C' are common electrodes for sustaining an electric discharge, while electrodes S and S' are scan electrodes that have both sustaining and scanning functions.

Electrodes S and C receive pulses of the negative (−) polarity, whereas electrodes S' and C' receive pulses of the positive (+) polarity.

That means, the electrodes are divided into groups of electrodes S-C and S'-C' and the polarities of the pulses applied to the group of electrodes S-C is opposite to those of the pulses applied to the electrode group S'-C'. Thus a scan can be performed in the upper electrodes S-C (lower electrodes S'-C') while sustain pulses are applied to the lower electrodes S'-C' (upper electrodes S-C).

To perform a scan in upper and lower fields once between the sustain pulses applied, the electrodes in groups S-C and S'-C' are subdivided into groups S1-C1-S2-C2 and S1'-C1'-S2'-C2', as shown in FIG. 7.

FIG. 8 is a typical waveform diagram of driving pulses for increasing the scanning speed by four times with the electrode arrangement in FIG. 7.

In the upper field, electrodes S1 and C2 are connected to a sustain voltage source of the negative (−) polarity, electrodes S2 and C1 being connected to another sustain voltage source of the negative (−) polarity, which is delayed by half a period with respect to the sustain voltage source connected to the S1-C2 electrodes.

In the lower field, electrodes S1' and C2' are connected to a sustain voltage source of the positive (+) polarity, electrodes S2' and C1' being connected to another sustain voltage source of the positive (+) polarity, which is delayed by half a period with respect to the sustain voltage source connected to the S1'-C2' electrodes.

The sustain pulses in the lower field are delayed by one fourth of a period with respect to those of the same type in the upper field.

When the sustain pulses are applied, as shown in FIG. 7, a scan can be done twice in a period of a sustain voltage waveform without overlapping the scan pulses applied to the electrodes S1 and S2. Thus, a scan is performed four times per period of a sustain voltage waveform in total.

As for data pulses $D_1$, data pulses $D^+$ of the positive (+) polarity are applied to the electrodes S1 and S2 for scanning the upper field, data pulses $D^-$ of the negative (−) polarity being applied to the electrodes S1' and S2' for scanning the lower field. Thus, data pulses of the positive (+) polarity cause a discharge in the cell of the S-C group, while data pulses of the negative (−) polarity cause a discharge in the cell of the S'-C' group.

The data pulses $D^+$ and $D^-$ are alternately applied and control the switching operation of a cell in synchronization with the scan pulses of the S1-S2 and S1'-S2' electrodes corresponding to them.

Erase pulses of the negative (−) polarity are used for the electrodes in the upper field, and those of the positive (+) polarity are applied to the electrodes in the lower field. After a predetermined time, all erase pulses are applied to scan electrodes S1, S2, S1' and S2'.

When the data pulses are applied, an addressing discharge occurs in the lower (upper) field while a sustain discharge takes place in the upper (lower) field.

FIG. 9 shows how data pulses for feeding an image in the lower field affect a sustain discharge when a cell in the upper field is off in the initial state.

Figure 9A:
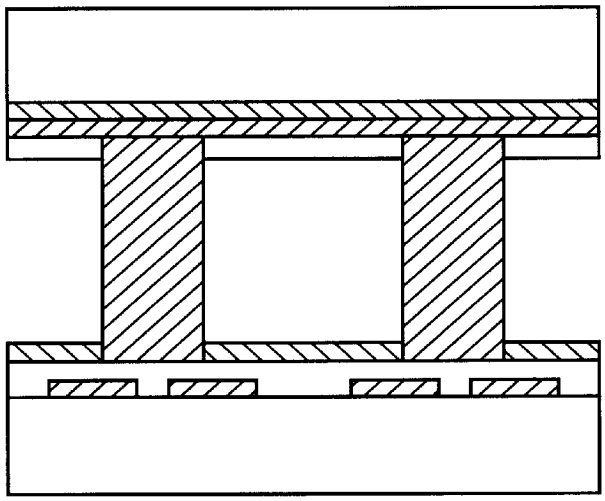
FIG. 9 illustrate the state of a cell switched "OFF" in FIG. 8, (A) initial state of the cell (B) when a negative data pulse is applied.

As shown in FIG. 9A, there is no wall charges on the respective electrodes, as shown in FIG. 9A.

Figure 9B:
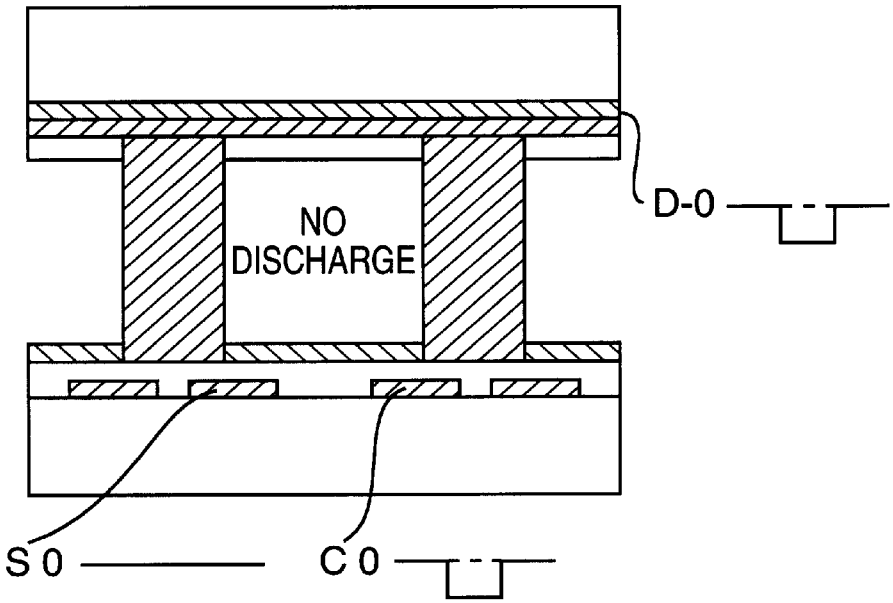

In that state, as shown in FIG. 9B, even when sustain pulses of the negative (−) polarity for causing a discharge are applied to the common electrodes C, and data pulses of the negative (−) polarity for feeding image data of the lower field are applied to the data electrodes D, the voltage applied is below the threshold voltage that is needed to cause an electric discharge between the S-C-D electrodes, thus causing no discharge in the cell.

While the previous condition is sustained with the data pulse applied to the lower field, no electric discharge occurs in the cell switched off in the upper field.

The same phenomenon may be seen when a voltage of the negative (−) polarity is applied to the scan and data electrodes S and D in the upper field, and also when sustain pulses of the positive (+) polarity for sustaining a discharge are applied to the electrodes S' and C', with data pulses of the positive (+) polarity for feeding image data of the upper field being applied to the data electrodes D.

FIG. 10 shows how data pulses for feeding an image in the lower field affect a sustain discharge when a cell in the upper field is switched on in the initial state.

Figure 10A:
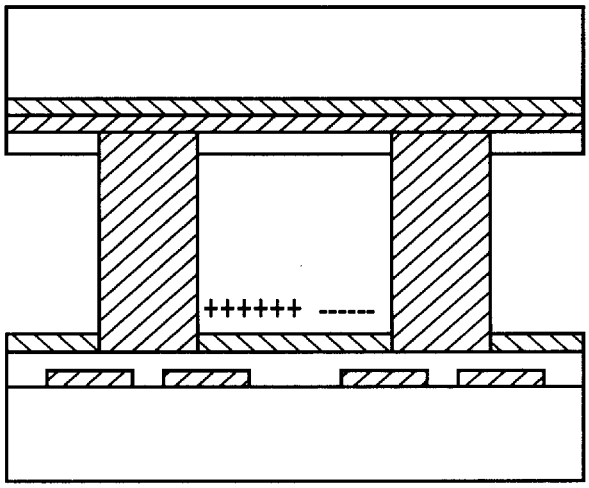
FIG. 10 illustrate the state of a cell switched "ON" in FIG. 8, (A) initial state of the cell (B) when a negative data pulse is applied (C) when a first positive data pulse is applied (D) when a second positive data pulse is applied.

As for a cell which is initially off, as shown in FIG. 10A, it is assumed that the electrodes S are electrically charged with positive wall charges with the electrodes C charged with negative wall charges.

Figure 10B:
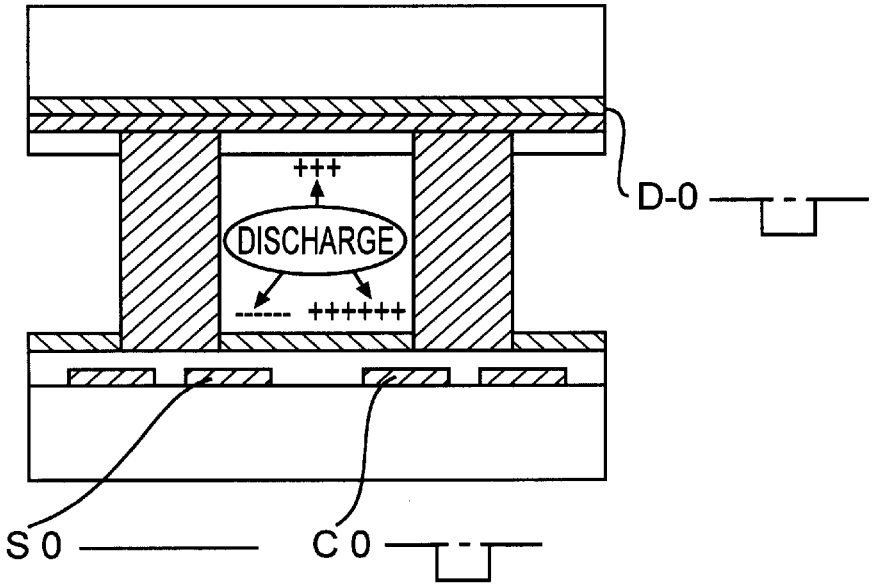

In that state, as shown in FIG. 10B, with the electrodes maintained in the "0" state, if sustain pulses of the negative polarity for causing a sustain discharge of the upper field are applied to the electrodes C, and data pulses of the negative polarity for feeding image data in the lower field are applied to the electrodes D, a normal sustain discharge occurs in the cell, forming wall charges under the electrodes D as well as the electrodes S and C according to the polarity of the pulses.

Figure 10C:
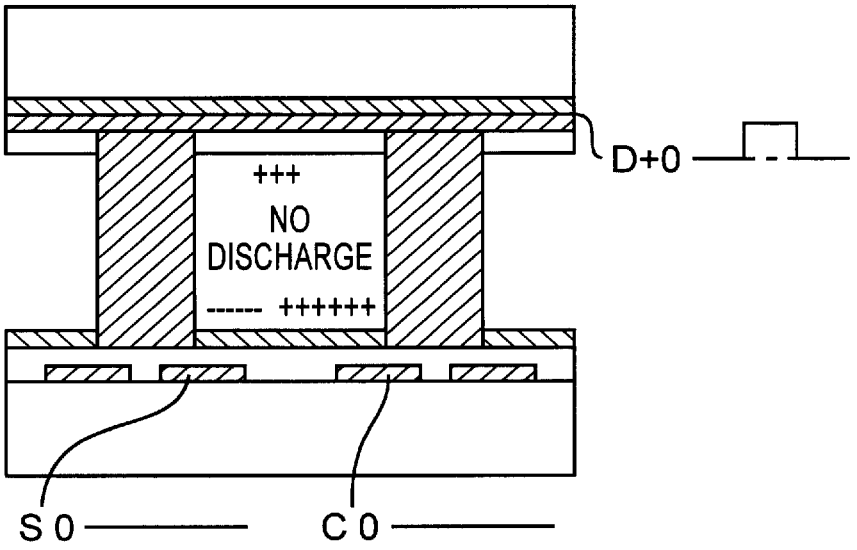

In the next to the state, when a scan pulse is not applied to the electrodes S and C, with a voltage of the positive (+) polarity applied to the electrode D in order to scan another horizontal electrode of the upper field, as shown in FIG. 10C, the wall charges under the electrode D will have the electric field between the electrodes D and S stronger, causing an unwanted discharge.

If an unwanted discharge occurs, the positive wall charges on the electrodes S and C are all changed to the negative charges so that the cell cannot be kept in the "on" state due to the sustain discharge caused.

Such an unwanted discharge can be prevented by reducing the amplitude of the data pulse applied to the electrode D, increasing that of the scan pulse, or decreasing the distance between the electrodes S and C.

Figure 10D:
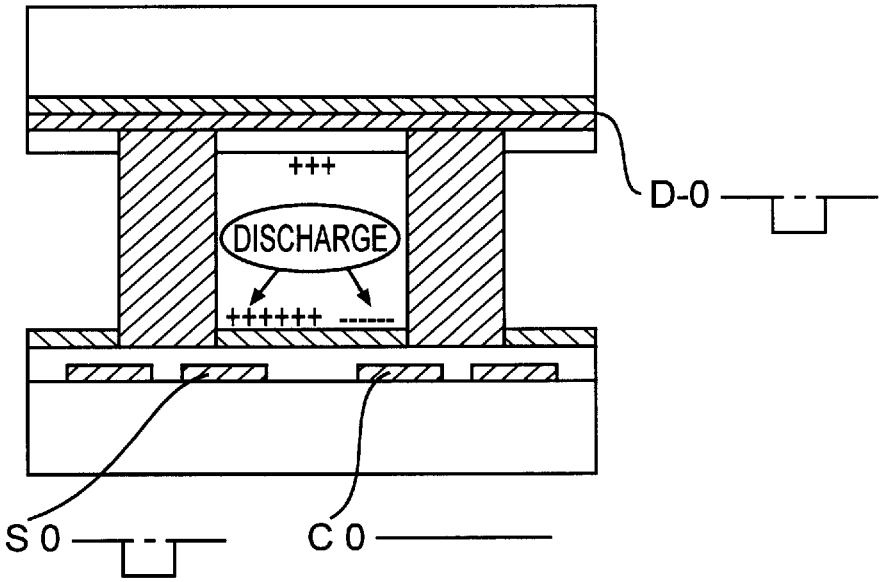

After the state of FIG. 10B, skipping the state of FIG. 10C, when data pulses of the negative (−) polarity for feeding image data of the lower field are applied while sustain pulses are applied to the electrodes S and C and in the "0" state, as shown in FIG. 10D, the wall charges under the electrodes D form the electric field that will decrease the electric field caused by the data pulses applied. Thus, a normal sustain discharge is not affected.

As a result, it should be noted that the condition given in FIG. 10C is considered to be most important and that the other conditions have to be unchanged in order to have no effect of the data pulse applied.

The same result will be achieved by sustain pulses of the positive (+) polarity to cause a sustain discharge in the lower field, and data pulses of the positive (+) polarity to feed image data in the upper field.

Figure 11:
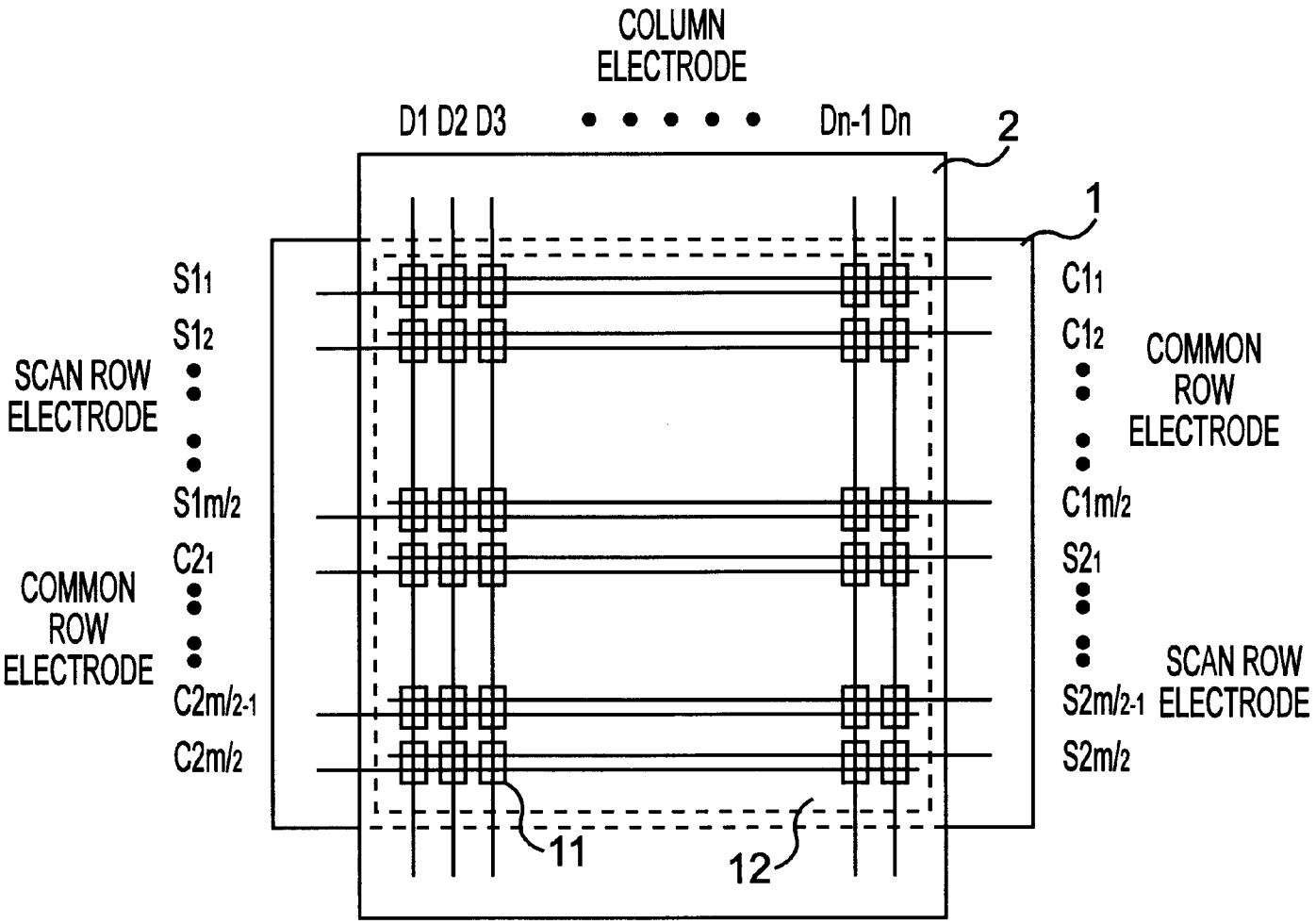
FIG. 11 is an electrode arrangement of an AC PDP designed to adopt FIG. 6A.

FIG. 11 illustrates an electrode arrangement revised in order to insert two scan pulses in a period of the sustain pulse.

Figure 1:
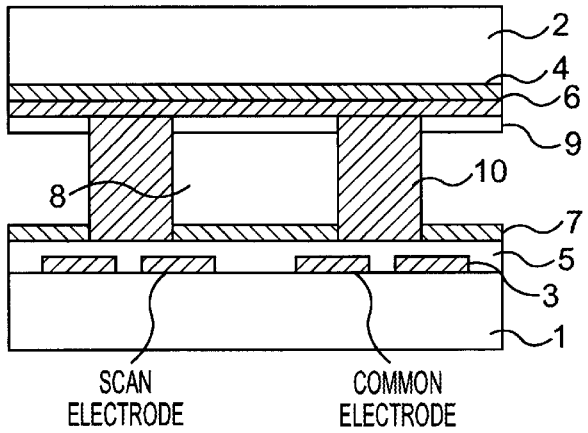
FIG. 1 shows the structure of a general three-electrode surface discharge AC PDP.
Figure 2:
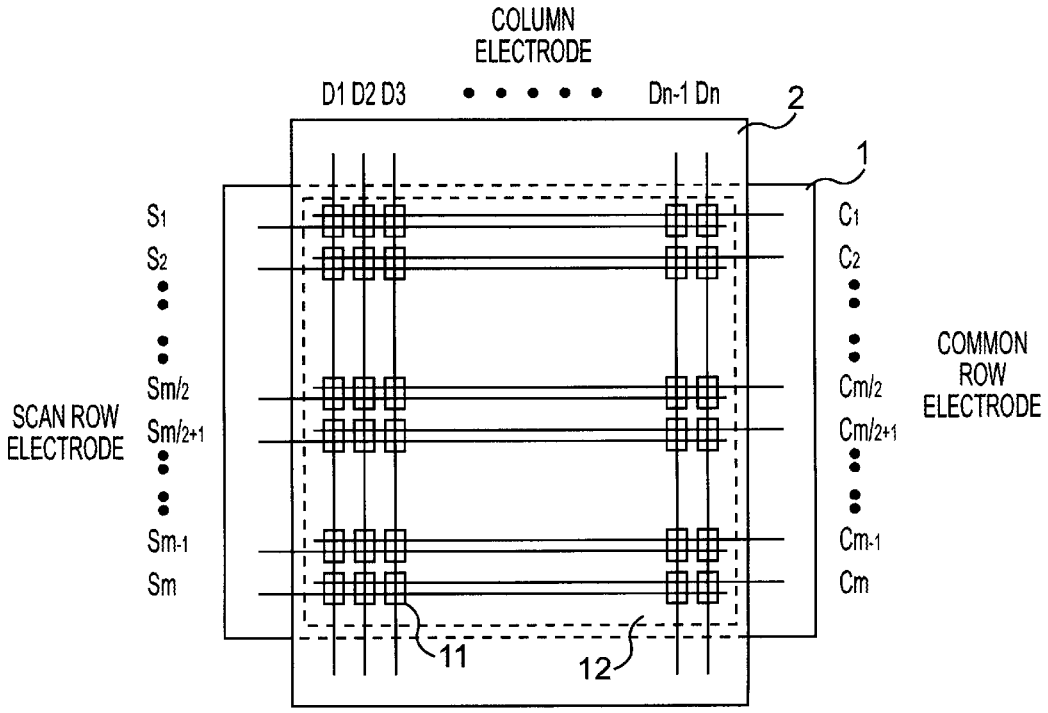
FIG. 2 shows the electrode arrangement of a general three-electrode surface discharge AC PDP.

Compared with the electrode arrangement in FIG. 2, on the left side is positioned scan electrodes in the upper part and common electrodes in the lower part, while on the right side is arranged common electrodes in the upper part and scan electrodes in the lower part.

The common electrodes perform only sustain function, but the scan electrodes do both sustain and scanning functions.

Irrespective of upper and lower parts, sustain voltage waveforms of the same polarity are alternately applied to the left and right sides in the same manner as the prior art driving method.

Figure 12:
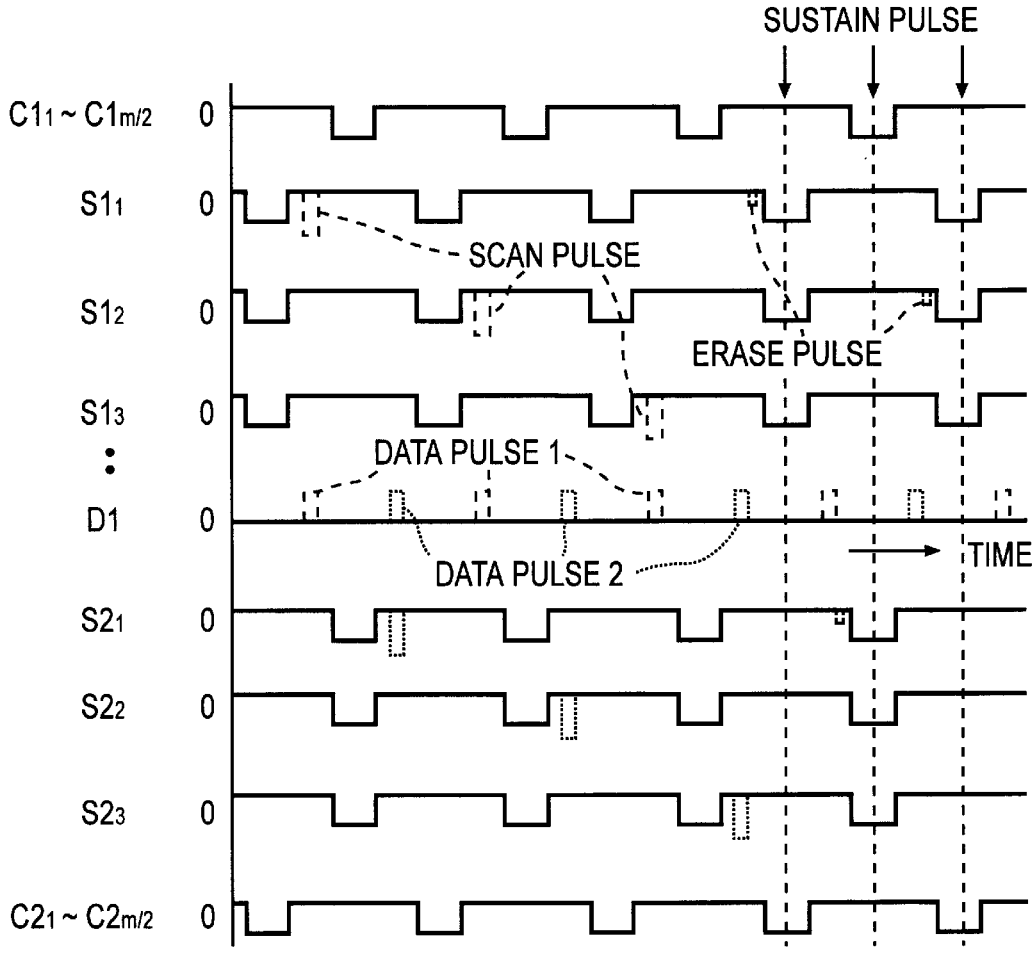
FIG. 12 is an entire waveform diagram of driving pulses to adopt FIG. 6A.

FIG. 12 is a typical waveform diagram of driving pulses for increasing the scanning speed by two times with the electrode arrangement shown in FIG. 11.

When electrodes C1 and S2 are connected to a sustain voltage source, and the electrodes C2 and S1 are connected to another sustain voltage source which is delayed by half a period with respect to the sustain waveform applied to the electrodes C1 and S2, a phase difference between the sustain waveforms applied to the electrode groups C1–C2 and S1–S2 is half a period of the sustain waveform.

The polarities of the sustain waveforms applied are all negative as in the conventional driving method.

Data pulses 1 to construct the upper part of a field and data pulses 2 to construct the lower part of the field are alternately applied. They are all synchronized with the corresponding scan pulses and control the switching operation of a cell.

The data pulses applied are all positive (+) in polarity, but all scan pulses are negative.

Erase pulses of the negative (−) polarity are applied to the scan electrodes S1 and S2 after a predetermined time, as in the conventional driving method.

Figure 3:
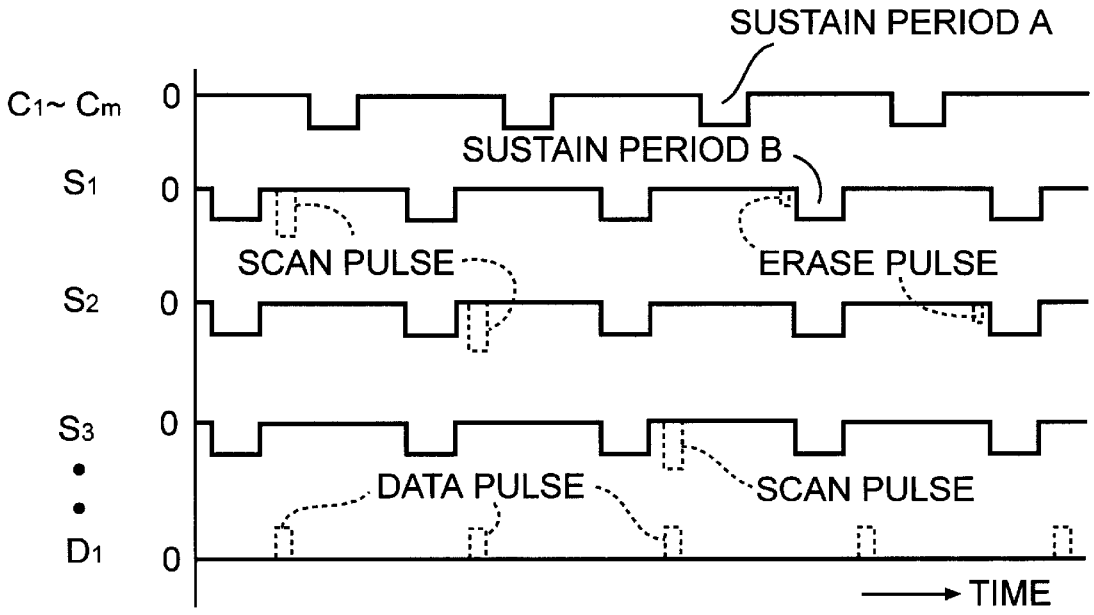
FIG. 3 is a waveform diagram of a driving waveform using the electrode arrangement of a general three-electrode surface discharge AC PDP.
Figure 4:
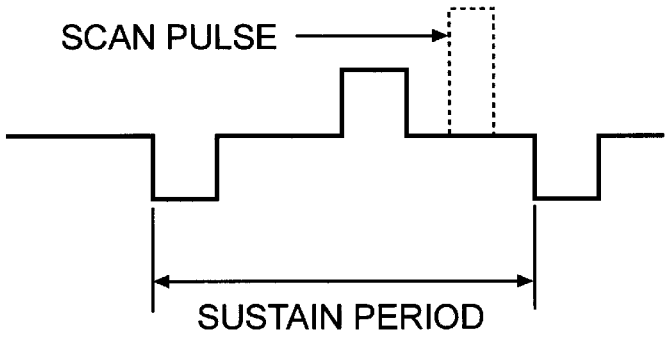
FIG. 4 is a waveform diagram of a basic driving waveform used in a conventional AC PDP.
Figure 5:
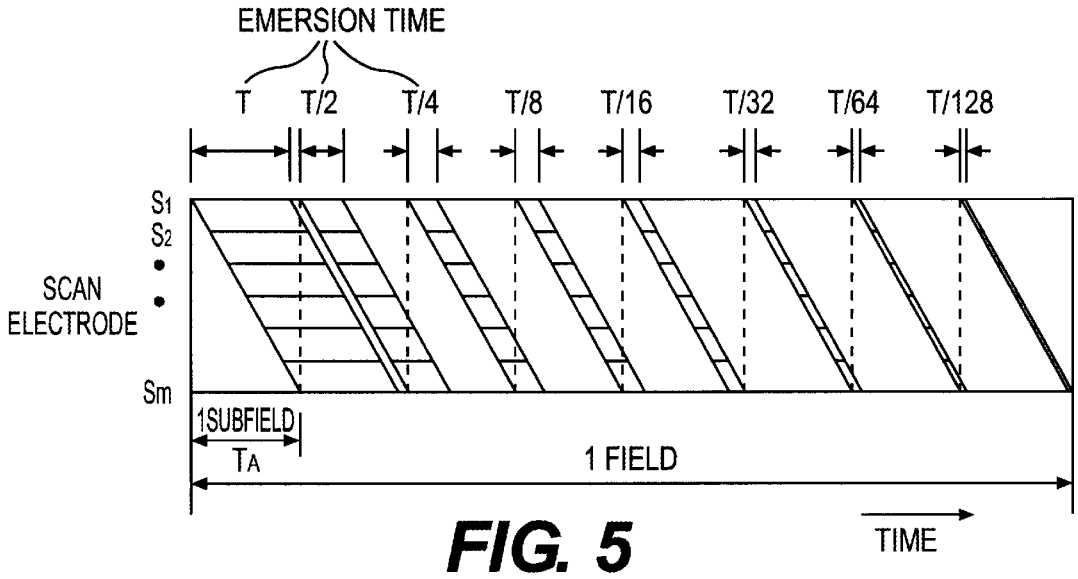
FIG. 5 illustrates a subfield scanning of the prior art.
Figure 6A:
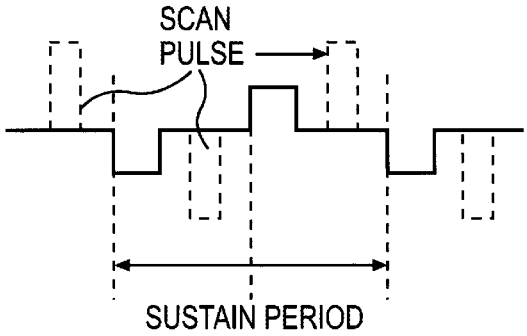
FIG. 6A is a waveform diagram showing the basic driving waveforms of S-C electrodes according to the present invention.
Figure 6B:
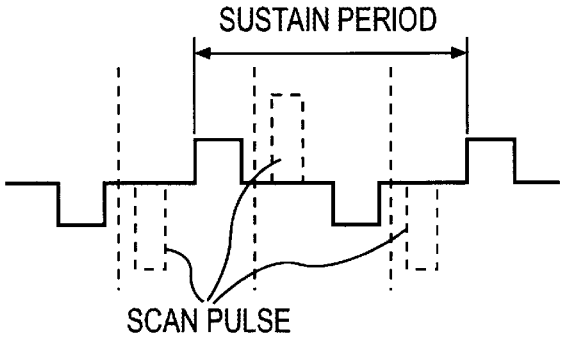
FIG. 6B is a waveform diagram showing the basic driving waveforms of S'-C' electrodes according to the present invention.

When the waveforms as shown in FIG. 3 are used to form a picture, a sequential scanning is performed from the upper part of the picture to the lower once per period of a sustain pulse. With the waveforms in FIG. 12 used, the whole field is divided into upper and lower parts, and scanning lines in the upper part are scanned at the same time with scanning lines in the lower part in a period of the sustain voltage waveform, so that a sequential scanning is vertically performed in the upper and lower parts of the picture in a separate way. Thus the time required for constructing the whole field can be reduced by half compared with the conventional method.

The waveforms as shown in FIG. 12, which are same in polarity as the waveforms in the conventional method, can be used to realize the driving circuit of the present invention, so that the complexity of a circuit construction is not increased.

FIGS. 13A–D are schematics of an AC PDP electrode arrangement capable of using a method of differentiating the phases of data and scan pulses, where the electrodes in the upper and lower parts of a field are arranged in order of {(S1,C1),S2,C2} in FIG. 13A, {(S1,C1),C2,S2} in FIG. 13B, {(C1,S1),S2,C2} in FIG. 13C, and {(C1,S1),C2,S2} in FIG. 13A. The time for a discharge can be prolonged in a three-electrode surface discharge AC PDP with various electrode arrangements as above, improving the luminance and contrast of the whole picture.

That means, the digital image signals are gathered by bits of a kind, from MSB to LSB $I_8$-$I_1$, the bits of even numbers $I_8$, $I_6$, $I_4$ and $I_2$ are scanned by using scan electrodes which are different from the scan electrodes for scanning the bits of odd numbers $I_7$, $I_5$, $I_3$ and $I_1$. When the subfield of odd (even) bits is scanned in the upper (lower) part of a field, the adjacent subfield of even (odd) bits is scanned in the lower (upper) part so that the scanning time to construct a field can be decreased with the enhancement of the luminance of an AC PDP picture compared with the conventional subfield scanning.

The waste time that cannot be used for a discharge will be minimized, thus enhancing the efficiency of the AC PDP, increasing the luminance of a picture, and reducing the flicker phenomenon caused by the difference between the times for a discharge.

FIG. 14 shows a basic electrode arrangement for realizing another objective of the present invention.

Unlike in the electrode arrangement of a conventional three-electrode surface discharge AC PDP as shown in FIG. 2 where the common electrodes receive only sustain pulses, in FIG. 14, the common electrodes have been replaced by the scan electrodes that can receive scan and erase pulses as well as sustain pulses. Each of the scan pulses applied to the electrodes S on the left side and the electrodes S' on the right side is positioned after the respective sustain pulses, without an overlap between the scan pulses. Thus two rows are scanned in a period of the sustain pulse, as shown in FIG. 15. Even bits $I_8$, $I_6$, $I_4$ and $I_2$ of a digital picture signal are transmitted into the position of data pulses 1, and they are scanned by using the electrodes S. Simultaneously, odd bits $I_7$, $I_5$, $I_3$ and $I_1$ applied to the position of data pulses 2 are scanned by using the electrodes S'. The subfield times corresponding to the bits are all determined as $$\frac{T_A}{2}$$

with the exception that the subfield time for the MSB $I_8$ is $T_A$. With this, as shown in FIG. 16, the number of row electrodes scanned in a given time is not more than two, and bits of a kind (odd-odd or even-even) are not concurrently scanned in different rows. The time $T_S$ that can be used for a discharge is the same as in the conventional subfield driving method, but the time $T_{NS}$ that is not used for a discharge is decreased. The time $T_{FIELD}$ needed to construct a field can be calculated as below.

$$\begin{aligned}
T_S &= \left(1+\frac{1}{2}+\frac{1}{4}+\frac{1}{8}+\frac{1}{16}+\frac{1}{32}+\frac{1}{64}+\frac{1}{128}\right)T_A \cong 2\,T_A \\
T_{NS} &= T_{NS1}+T_{NS2}+T_{NS3}+T_{NS4}+T_{NS5}+T_{NS6} \\
&= \left(\frac{T_A}{2}-T_6\right)+\left(\frac{T_A}{2}-T_5\right)+\left(\frac{T_A}{2}-T_4\right)+\left(\frac{T_A}{2}-T_3\right)+ \\
&\quad \left(\frac{T_A}{2}-T_2\right)+\left(\frac{T_A}{2}-T_1\right) \\
&= \left(\frac{1}{4}+\frac{3}{8}+\frac{7}{16}+\frac{15}{32}+\frac{31}{64}+\frac{63}{128}\right)T_A \\
&\cong 2.5\,T_A
\end{aligned}$$

where $T_6$ is the time that can be used for a discharge of bit $I_6$, $T_5$ the time used for a discharge of bit $I_5$, . . . , $T_1$ the time for a discharge of bit $I_1$, and $T_A$ represents the time required for scanning all row electrodes.

Thus, the efficiency is $$\frac{T_A}{T_{FIELD}}\times 100 = \frac{2T_A}{4.5\,T_A}\times 100 = 44.5\%$$

The efficiency is enhanced by around two times compared with the conventional subfield scanning.

More satisfactory characteristic can be attained when the subfield scanning to separately drive odd and even bits is adopted in the field split driving method by which upper and lower parts of a field are independently driven. FIG. 17 illustrates an electrode arrangement to realize the field split driving method. Unlike the electrode arrangement in FIG. 14, the whole panel is divided into two fields; the upper electrodes are divided into two groups of electrodes S1 and S1' while the lower electrodes are divided into two groups of electrodes S2 and S2'. As shown in FIG. 18, sustain pulses of the negative polarity are applied to the upper electrodes, with the sustain pulses of the positive (+) polarity applied to the lower electrodes.

A phase difference being half a period is given between the sustain pulses of the electrodes S1 and S1' in the upper field, and between the sustain pulses of the electrodes S2 and S2' in the lower field. The sustain pulses of the upper field are delayed at time intervals of one fourth of a period with respect to the sustain pulses of the lower field. With the sustain pulses applied, the scan pulses applied to the electrodes S1 do not overlap with those applied to the electrodes S1', as shown in FIG. 18, so that a scanning is performed two times in a period of the sustain voltage waveform. The electrodes S1-S1' and S2-S2' can also be scanned without an overlap between their scan pulses in the same way. Thus, a scanning is performed four times in a period of the sustain voltage waveform in total.

As for data pulses $D_1$, data pulses $D^+$ of the positive (+) polarity are applied to the electrodes S1 and S1' for scanning the upper field, data pulses $D^-$ of the negative (–) polarity being applied to the electrodes S2 and S2' for scanning the lower field. Data pulses $D^+$ and $D^-$ are alternately applied to control the switching operation of a cell in synchronization with the scan pulses of the electrodes S1-S1' and S2-S2' corresponding to them respectively. Erase pulses of the negative (–) polarity are used for the upper field and those of the positive (+) polarity are for the lower field. All erase pulses are applied to the scan electrodes S1, S1', S2 and S2' after a predetermined time. When the data pulses are applied, the upper (lower) field is scanned while a sustain discharge occurs in the lower (upper) field.

Upper and lower subfields split from a field are separately scanned in the electrode arrangement to realize a field split driving method as illustrated in FIG. 17. When the subfield scanning method by which odd and even bits are scanned in a separate way is adopted in the electrode arrangement in FIG. 17, a scanning can be performed in the same manner as illustrated in the former section of the FIG. 16, as shown in FIG. 19. Referring to FIG. 19, upper and lower parts of a field are scanned concurrently and the time required for scanning the field is $$\frac{T_A}{2},$$

so that two subfields in upper or lower part of the field are not scanned at the same time. Since odd and even bits are separately scanned in the split field by using two different electrodes, the subfield time for each bit $I_6$–$I_5$ is determined as $$\frac{T_A}{4}$$

and the interval between the subfields $I_4$ and $I_5$ can be removed, as shown in FIG. 20. $T_S$, $T_{NS}$, $T_{FIELD}$, and the efficiency are calculated as $T_S=2T_A$ (same as FIG. 16)

$$\begin{aligned} T_{NS} &= T_{NS1}+T_{NS2}+T_{NS3}+T_{NS4}+T_{NS5} \\ &= \left(\frac{T_A}{4}-T_5\right)+\left(\frac{T_A}{4}-T_4\right)+\left(\frac{T_A}{4}-T_3\right)+\left(\frac{T_A}{4}-T_2\right)+\left(\frac{T_A}{4}-T_1\right) \\ &= \left(\frac{T_A}{4}-\frac{T_A}{8}\right)+\left(\frac{T_A}{4}-\frac{T_A}{16}\right)+\ldots+\left(\frac{T_A}{4}-\frac{T_A}{128}\right) \\ &\cong T_A \end{aligned}$$

$T_{FIELD}=T_S+T_{NS}=3T_A$ $$\text{Efficiency}=\frac{T_s}{T_{FIELD}}\times 100=\frac{2T_A}{3T_A}\times 100=66.7$$

Instead of $T_A$, $$\frac{T_A}{2}$$

is used to calculate $T_{NS}$ because the panel to drive is divided into upper and lower parts. Compared with a scanning method using the electrode arrangement in FIG. 14, the efficiency was enhanced by around 1.5 times owing to $T_{NS}$ decreased by 1.5 $T_A$.

FIG. 14 illustrates a basic electrode arrangement for realizing another object of the present invention.

Compared to the electrode arrangement of a conventional three-electrode surface discharge AC PDP as shown in FIG. 2 where common electrodes receive only sustain pulses, in FIG. 14, the common electrodes have been replaced by the scan electrodes that can receive scan and erase pulses as well as sustain pulses. In the electrode arrangement, as shown in FIG. 15, scan pulses applied to the electrodes S on the left side and to the electrodes S' on the right side are each positioned after sustain pulses. Thus the scan pulses do not overlap with one another and two rows are scanned in a period of the sustain pulse.

If a digital picture signal has the MSB $I_8$, upper bits $I_8$ to $I_5$, and lower bits $I_4$ to $I_1$, the bits are divided into four pairs of bits (lower bit, upper bit) where each bit is used once. Four upper bits are applied to the position of data pulses 1 and scanned with electrodes 8, while four lower bits are applied to the position of data pulses 2 and scanned with electrodes S'. Lower and upper bits in each pair of bits are successively scanned in each row over time, but bits of a kind (upper-upper or lower-lower) are not concurrently scanned in different rows. That means, upper-upper bits or lower-lower bits in different rows are scanned by using all electrodes S and S'. When bits of a kind have to be scanned in two different rows at the same time, pairs of bits are separately scanned at time intervals between them. In each row, the upper bit to be driven is scanned with electrode S and the lower bit is scanned with electrode S'.

As described above, when the three-electrode AC PDP is driven, the lower bits are positioned before the upper bits and they are successively scanned with the upper bits at the same time. This solves a problem of the waste of time which was the most troublesome in the prior art and reduces a flicker phenomenon caused by the difference between discharging times.

FIG. 21 illustrates the sequence of scanning a field over time in the lower bit preceding scanning method as described above. The pairs of bits are ($I_1$, $I_8$), ($I_2$, $I_7$), ($I_3$, $I_6$), and ($I_4$, $I_5$). If the time that can be used for a discharge of the MSB is made equal to the existing subfield time $T_A$, the time $T_S$ that can be used for discharge is $$\begin{aligned} T_S &= T_8+T_7+T_6+T_5+T_4+T_3+T_2+T_1 \\ &= \left(1+\frac{1}{2}+\frac{1}{4}+\frac{1}{8}+\frac{1}{16}+\frac{1}{32}+\frac{1}{64}+\frac{1}{128}\right)\times T_A \approx 2T_A \end{aligned}$$

where $T_8$ is the light-emitting time of bit (MSB) $I_8$, $T_7$ the time of bit $I_7$, . . . , $T_1$ the time of bit (LSB) $I_1$, and $T_A$ represents the time required for scanning all row electrodes once.

The time $T_s$ is around $2T_A$. The time $T_{NS}$ that cannot be used for a discharge is calculated, as follows:

$$T_{NS}=\left\{\left(1-\frac{1}{2}\right)+\left(1-\frac{1}{4}\right)+\left(1-\frac{1}{8}\right)\right\}\times T_A \approx 2T_A \tag{1}$$

$T_{NS}$ is used in order that bits of a kind cannot be scanned in different rows at the same time in case of bits $I_7$, $I_6$, and $I_5$, as described above. Since the time $T_{FIELD}$ needed to scan a field is $T_S+T_{NS1}$, the efficiency is $$\frac{T_S}{T_{FIELD}}\times 100=\frac{2}{4}\times 100=50\%$$

The efficiency is enhanced by around two times compared with the conventional scanning method.

FIG. 22 illustrates a scanning method where the time for a discharge of the MSB is incremented by two times compared to the method in FIG. 21 in order to increase the time $T_S$ for a discharge. Because the times for all bits are doubled and $T_S$ is $4T_A$, bits of a kind cannot be scanned in different rows at the same time and a time interval between the pairs of bits is needed only for scanning $I_6$ and $I_5$. Thus, the time $T_{NS}$ that cannot be used for a discharge is calculated:

$$T_{NS} = \left\{\left(1-\frac{1}{2}\right)+\left(1-\frac{1}{4}\right)\right\}\times T_A = 1.25\ T_A \tag{2}$$

Instead of $$\frac{1}{4T_A} \text{ and } \frac{1}{8T_A}$$

in equation (1), $$\frac{1}{2T_A} \text{ and } \frac{1}{4T_A}$$

are used because the time for each bit is doubled. Since $T_{FIELD}=T_S+T_{NS}=5.25T_A$, the efficiency is calculated as $$\frac{T_S}{T_{FIELD}}\times 100 = \frac{4}{5.25}\times 100 = 76.2\%$$

The efficiency is enhanced by around three times compared to the conventional scanning method.

FIG. 23 illustrates a scanning method where the time for a discharge of the MSB is incremented by four times compared to the method in FIG. 21 in order to increase $T_S$. Because the times for all bits are increased by four times and $T_S$ is $8T_A$, bits of a kind cannot be scanned in different rows at the same time and a time interval between the pairs of bits is needed only for scanning $I_5$. Thus, $T_{NS}$ is:

$$T_{NS} = \left(1-\frac{1}{2}\right)\times T_A = 0.5\ T_A \tag{3}$$

Instead of $$\frac{1}{8T_A}$$

in equation (1), $$\frac{1}{2T_A}$$

is used because the time for each bit is increased by four times. Thus, $T_{FIELD}=T_S+T_{NS}=8.5T_A$. The efficiency is incremented by about three times compared to the conventional scanning method, and calculated as $$\frac{T_S}{T_{FIELD}}\times 100 = \frac{8}{8.5}\times 100 = 94.1\%$$

If the time for discharging the MSB is increased by more than four times compared to the method as illustrated in FIG. 21, the times for all bits are incremented by four times or more and thus $T_S$ becomes above $16T_A$. Since the time $T_5$, light-emitting time for $I_5$ is above $T_A$, $T_{NS}$ is decreased to zero and the efficiency is approximately 100%. When the time for discharging the MSB is too short, almost time is spent in scanning a field that cannot cause an electric discharge and the efficiency reaches 0%.

FIGS. 24 and 25 show the variations of $T_{NS}$ and $T_{FIELD}$ when $T_S$ is changed, as described above. Referring to FIG. 24, $T_{NS}$ is decreased with the increase of $T_S$, enhancing the efficiency. FIG. 25 shows that $T_{FIELD}$ is needed to increase with $T_S$. Accordingly, an optimized scanning method using the lower bit preceding scanning method must be determined in consideration of the efficiency and $T_{FIELD}$ in the procedures below.

a) Determine $T_A$ and $T_{FIELD}$.

b) Select $T_S$ corresponding to $T_{FIELD}$ by using the method in FIG. 25.

c) Select $T_{NS}$ corresponding to $T_S$ by using the method in FIG. 24.

d) From the fact that the time $T_8$ for the MSB is half of $T_S$, determine the times allotted to other bits.

$T_A$ and $T_{FIELD}$ are predetermined values according to the PDP's standard and the television broadcasting system.

More satisfactory characteristic will be attained when the lower bit preceding scanning method is adopted in the field split driving method. An electrode arrangement to realize the field split driving method is illustrated in FIG. 17. Unlike the electrode arrangement in FIG. 14, the whole panel is divided into two fields; the upper electrodes are divided into two groups of electrodes S1 and S1' while the lower electrodes are into two groups of electrodes S2 and S2'. As shown in FIG. 18, sustain pulses of the negative (−) polarity are applied to the upper electrodes, with the sustain pulses of the positive (+) polarity applied to the lower electrodes.

A phase difference, half a period is given between the sustain pulses of the electrodes S1 and S1' in the upper field, and between the sustain pulses of the electrodes S2 and S2' in the lower field. The sustain pulses of the upper field are delayed at time intervals of one fourth of a period with respect to the sustain pulses of the lower field. With the sustain pulses applied, the scan pulses applied to the electrodes S1 are not overlapped with those applied to the electrodes S1', as shown in FIG. 18, so that a scanning is performed two times in a period of the sustain voltage waveform. The electrodes S1–S1' and S2–S2' can also be scanned without an overlap between their scan pulses in the same way. Thus, a scanning is performed four times in a period of the sustain voltage waveform in total.

As for data pulses $D_1$, data pulses D+ of the positive (+) polarity are applied to the electrodes $S_1$ and S1' for scanning the upper field, data pulses $D^-$ of the negative (−) polarity being applied to the electrodes S2 and S2' for scanning the lower field. Data pulses $D^+$ and $D^-$ are alternately applied to control the switching operation of a cell in synchronization with the scan pulses of the electrodes S1–S1' and S2–S2' corresponding to them respectively. Erase pulses of the negative (−) polarity are used for the upper field and those of the positive (+) polarity are for the lower field. All erase pulses are applied to the scan electrodes S1, S1', S2 and S2' after a predetermined time. When the data pulses are applied, the upper (lower) field is scanned while a sustain discharge occurs in the lower (upper) field.

Upper and lower subfields split from a field are separately scanned in the electrode arrangement to realize a field split driving method as illustrated in FIG. 17. When the lower bit preceding scanning method is adopted in the electrode arrangement in FIG. 17, a scanning can be performed in the same manner as illustrated in the former section of the FIG. 13, as shown in FIG. 26. Referring to FIG. 26, upper and lower parts of a field are scanned concurrently and the time required for scanning the field is $$\frac{T_A}{2}$$

so that bits of a kind in different rows are not scanned in two subfields in upper or lower part of the field at the same time. Thus, the time interval between pairs of bits is needed only for scanning $I_6$ and $I_5$, reducing the time $T_{NS1}$ that cannot be used for a discharge as $$T_{NS1} = \frac{T_A}{2}.$$

FIG. 27 illustrates a lower bit preceding scanning method where the time is excluded. Referring to FIG. 27, $T_S$, $T_{NS}$, $T_{FIELD}$, and the efficiency are calculated as:

$T_S=2T_A$ (same as FIG. 21)

$$\begin{aligned} T_{NS} &= T_{NS1} + T_{NS2} \\ &= \left(\frac{T_A}{2} - T_5\right) + \left(\frac{T_A}{2} - T_4\right) \\ &= \left(\frac{T_A}{2} - \frac{T_A}{4}\right) + \left(\frac{T_A}{2} - \frac{T_A}{8}\right) \\ &= 0.625\ T_A \end{aligned}$$

$$\text{Efficiency} = \frac{T_A}{T_{FIELD}} \times 100 = \frac{2\,T_A}{2.625\ T_A} \times 100 = 76.2\%$$

Compared to the conventional method, the efficiency was enhanced by around 3 times. Instead of $T_A$, $$\frac{T_A}{2}$$

is used because the panel to drive is divided into upper and lower parts.

FIG. 28 illustrates a scanning method where the time for a discharge of the MSB is doubled compared to the method in FIG. 27 in order to increase $T_S$. Because the times for all bits are increased by 2 times and $T_S$ is $4T_A$, bits of a kind cannot be scanned in different rows at the same time when scanning $I_7$ and $I_6$, and a time interval between the pairs of bits is needed only for scanning $I_5$. Thus $T_S$, $T_{NS}$, $T_{FIELD}$, and the efficiency are calculated as: $T_S=4T_A$ (same as FIG. 22)

$$\begin{aligned} T_{NS} &= T_{NS1} \\ &= \left(\frac{T_A}{2} - T_4\right) \\ &= \left(\frac{T_A}{2} - \frac{T_A}{4}\right) \\ &= 0.25\,T_A \end{aligned}$$

$$\text{Efficiency} = \frac{T_A}{T_{FIELD}} \times 100 = \frac{4\,T_A}{4.25\ T_A} \times 100 = 94.1\%$$

No more optimization is not needed then.

The lower bit preceding scanning method is described based on the electrode arrangements in FIGS. 14 and 17, but it can be adopted in other electrode arrangements and applied to digital signals as well as 8-bit signals.

According to the present invention, the whole panel is divided into upper and lower parts S and S', the upper part S being subdivided into upper-upper and upper-lower parts S1 and S2, the lower part S' being subdivided into lower-upper and lower-lower parts S1' and S2'. In a period of the sustain pulse, the whole panel is vertically scanned in sequence of upper-upper, upper-lower, lower-upper, and lower-lower parts. By reducing the total time required for scanning the scan electrodes of the whole field by a quarter, the amount of data to be processed in unit time is increased even in a PDP that is slow in the response speed of cells and the time for a discharge of a cell can be incremented, thus improving the luminance and contrast of the field.

In the present invention, upper and lower part of a field are not physically separated from each other, but they are driven in a period of the sustain pulse at the same time, reducing the time required for scanning the whole field by half to increase the time for discharging a PDP cell, thus improving the luminance and contrast of the field. The present invention can attain the same results by using sustain, scan and erase pulses of the positive (+) polarity, and data pulses of the negative (−) polarity as well as sustain, scan and erase pulses of the negative (−) polarity, and data pulses of the positive (+) polarity.

In a subfield scanning method by separately driving even and odd bits according to the present invention, two adjacent subfields of a digital picture signal can be scanned at the same time so that an increased amount of data can be readily processed in an AC PDP. The present invention can adopt a field split driving method where a field is divided into upper and lower subfields and separately driven, for the purpose of higher efficiency of the PDP.

In a lower bit preceding scanning method, pairs of bits composed of lower bit and upper bit are arranged in a proper sequence. The lower bits in pairs of bits are scanned first and the upper bits are successively scanned, enhancing the efficiency of the AC PDP and reducing the time needed to construct the field, so that an increased amount of data can be readily processed in a large-sized PDP. The upper bits taking much time for a discharge and the lower bits having a short discharging time forms pairs of bits and they are successively scanned, thus reducing a flicker phenomenon due to the difference between the discharging times.

It will be apparent to those skilled in the art that various modifications and variations can be made in a method of and system for driving an AC PDP according to the present invention without departing from the spirit or scope of the invention. Thus, it is intended that the present invention cover the modifications and variations of this invention provided they come within the scope of the appended claims and their equivalents.

What is claimed is:

1. A method of driving a plasma display panel having a plurality of row electrodes and a plurality of column electrodes crossing said row electrodes, the method comprising:

displaying a digital picture signal in a grey level with a plurality of bits from the most significant bit to the least significant bit, each adjacent, less significant bit corresponding to less displaying time than an adjacent, more significant bit;

dividing said plurality of bits into at least two groups; and scanning one group of said at least two groups of bits using one group of scan electrodes and scanning another group of bits using another group of scan electrodes, wherein said plurality of bits include even bits $I_8$, $I_6$, $I_4$, $I_2$ and odd bits $I_7$, $I_5$, $I_3$ and $I_1$, wherein time intervals between subfields of the bits from the most significant bit $I_8$ to the least significant bit $I_1$ are determined as 0, 0, $T_{NS1}$, $T_{NS2}$, $T_{NS3}$, $T_{NS4}$, $T_{NS5}$ and $T_{NS6}$, and wherein $T_{NS1}=T_A/4$; $T_{NS2}=3T_A/8$; $T_{NS3}=7T_A/16$; $T_{NS4}=15T_A/32$; $T_{NS5}=31T_A/64$; $T_{NS6}=63T_A/128$; and $T_A$ is the time required for scanning all of said plurality of row electrodes.

2. The method as defined in claim 1, wherein said scanning step includes scanning said even bits with a driving signal having a phase different from the phase of the driving signal scanning said odd bits.

3. The method as defined in claim 2, wherein said scanning step includes scanning a subfield of said odd bits in an upper part of a field while scanning another adjacent subfield of said even bits in the lower part of the field, and scanning a subfield of said even bits in a lower part of the field while scanning another adjacent subfield of said odd bits in the upper part of the field.

4. The method as defined in claim 2, further comprising:

applying a scan signal to one row electrode in synchronization with a data signal representing said odd bits and to another row electrode in synchronization with a data signal representing said even bits.

5. The method as defined in claim 2, further comprising driving said even bits and said odd bits successively with respect to a time period of a sustain signal.

6. A method of driving a plasma display panel having a plurality of row electrodes and a plurality of column electrodes crossing said row electrodes, the method comprising:

dividing said row electrodes into at least two groups corresponding to upper and lower parts of a field;

displaying a digital picture signal in a grey level as 8 bits including even bits $I_8$, $I_6$, $I_4$, and $I_2$, and odd bits $I_7$, $I_5$, $I_3$, and $I_1$; and applying a driving signal to one group of said row electrodes to scan said odd bits $I_{7,\ I5}$, $I_3$ and $I_1$ and to another group of said row electrodes to scan said even bits $I_8$, $I_6$, $I_4$ and $I_2$, wherein time intervals between subfields of the bits from the most significant bit $I_8$ to the least significant bit $I_1$ are determined as 0, 0, 0, $T_{NS1}$, $T_{NS2}$, $T_{NS3}$, $T_{NS4}$ and $T_{NS5}$, and wherein $T_{NS1}=T_A/8$; $T_{NS2}=3T_A/16$; $T_{NS3}=7T_A/32$; $T_{NS4}=15_A/64$; $T_{NS5}=31T_A/128$; and $T_A$ is the time required for scanning all row electrodes.

7. The method as defined in claim 6, further comprising applying a scan signal to a first row electrode in synchronization with a data signal representing said odd bits and to a second row electrode in synchronization with a data signal representing said even bits, the first row electrode corresponds to the upper part of the field, the second electrode corresponding to the lower part of the field.

8. The method as defined in claim 6, further comprising applying a sustain signal to the row electrode, wherein a phase difference between sustain signals representing the upper and lower parts of the field is one fourth of a time period of the sustain signal, and said sustain signals being opposite to one another in polarity.

9. A method of driving a plasma display panel having a plurality of row electrodes and a plurality of column electrodes crossing said row electrodes, the method comprising:

displaying a picture signal in a grey level with a plurality of bits, each adjacent, less significant bit corresponding to less displaying time than an adjacent, more significant bit;

dividing said plurality of bits into four pairs of said lower and upper bits as ($I_1$, $I_8$), ($I_2$, $I_7$), ($I_3$, $I_6$), and ($I_4$, $I_5$);

scanning the lower bit and the upper bit in each pair successively; and scanning each of said four pairs successively until all of the four pairs are completely scanned, wherein time intervals between said four pairs of said lower and upper bits ($I_1$, $I_8$), ($I_2$, $I_7$), ($I_3$, $I_6$), and ($I_4$, $I_5$), are determined as 0, $T_{NS1}$, $T_{NS2}$ and $T_{NS3}$, wherein $T_{NS1}=T_A/2$; $T_{NS2}=3T_A/4$; $T_{NS3}=7T_A/8$; and $T_A$ is the time required to scan all row electrodes.

10. The method as defined in claim 9, further comprising applying a scan signal to a first row electrode in synchronization with a data signal representing said lower bits and a second row electrode in synchronization with a data signal representing said upper bits.

11. A method of driving a plasma display panel having a plurality of row electrodes and a plurality of column electrodes crossing said row electrodes, the method comprising:

displaying a picture signal in a grey level with a plurality of bits, each adjacent, less significant bit corresponding to less displaying time than an adjacent, more significant bit;

dividing said plurality of bits into four pairs of lower and upper bits as ($I_1$, $I_8$), ($I_2$, $I_7$), ($I_3$, $I_6$), ($I_4$, $I_5$);

scanning the lower bit and the upper bit in each pair successively; and scanning each of said four pairs successively until all of the four pairs are completely scanned, wherein time intervals between said four pairs of bits ($I_1$, $I_8$), ($I_2$, $I_7$), ($I_3$, $I_6$), ($I_4$, $I_5$), are determined as 0, 0, $T_{NS1}$ and $T_{NS2}$ by prolonging the time of a discharge of the most significant bit, and wherein $T_{NS1}=T_A/2$; $T_{NS2}=3T_A/4$; and $T_A$ is the time required to scan all row electrodes.

12. A method of driving a plasma display panel having a plurality of row electrodes and a plurality of column electrodes crossing said row electrodes, the method comprising:

displaying a picture signal in a grey level with a plurality of bits, each adjacent, less significant bit corresponding to less displaying time than an adjacent, more significant bit;

dividing said plurality of bits into four pairs of lower and upper bits as ($I_1$, $I_8$), ($I_2$, $I_7$), ($I_3$, $I_6$), and ($I_4$, $I_5$);

scanning the lower bit and the upper bit in each pair successively; and scanning each of said four pairs successively until all of the four pairs are completely scanned, wherein time intervals between said four pairs of bits ($I_1$, $I_8$), ($I_2$, $I_7$), ($I_3$, $I_6$) and ($I_4$, $I_5$) are determined as 0, 0, 0 and $T_{NS1}$ by prolonging the time of a discharge of the most significant bit, and wherein $T_{NS1}=T_A/2$ and $T_A$ is the time required to scan all row electrodes.

13. A plasma display panel driving system, comprising:

one or more column electrodes for receiving data signals; and a plurality of scan electrodes crossing said common electrodes for receiving sustain and scan signals, wherein said scan electrodes are divided into four groups representing split fields corresponding to upper-upper, upper-lower, lower-upper, and lower-lower parts of a field, wherein said scan signal received by one of said four groups of each said scan electrode has a phase different from that by another of said four groups by one fourth of a time period of the sustain signal.

14. The system as defined in claim 13, wherein said scan electrodes are divided into four groups corresponding to upper-upper, upper-lower, lower-upper, and lower-lower parts of a field, said scan signal received by one of said four groups of said scan electrode has a phase different from that by another of said four groups by one fourth of a time period of the sustain signal.

15. The system as defined in claim 13, further comprising one or more common electrodes for receiving a sustain signal, wherein the upper-upper and upper-lower parts of the field, using the sustain signal of a negative (−) polarity, have a first set of the common and scan electrodes and connected to a first sustain voltage source, and a second set of the common and scan electrodes is connected to a second sustain voltage source which is delayed by half a time period with respect to waveforms applied to the first set of the common and scan electrodes;

wherein the lower-upper and lower-lower parts of the field, using the sustain signal of a positive (+) polarity, have a third set of the common and scan electrodes connected to a third sustain voltage source which is delayed by one fourth of a period with respect to the sustain waveforms applied to the first set of the common and scan electrodes, and a fourth set of the common and scan electrodes is connected to a fourth sustain voltage source which is delayed by half a period with respect to the waveforms applied to the third set of the common and scan electrodes;

wherein the scan signal of the upper-upper and lower-upper parts of the field is inserted between the sustain signal applied to a first set of the scan electrodes with a phase difference being half a time period of the sustain pulse by using the scan signal of the negative (−) polarity, and the scan pulses of the lower-lower and upper-lower parts of the field being inserted between the sustain pulses applied to a second set of the scan electrodes with a phase difference being half a time period of the sustain pulse by using the scan pulses of the positive (+) polarity; and wherein the upper-upper; upper-lower, lower-upper, and lower-lower parts of the field are sequentially scanned in a period of the sustain pulse.

16. The system as defined in claim 13, wherein said data signals include a positive data pulse of a positive (+) polarity corresponding to one of said split fields and a negative data pulse of a negative (−) polarity corresponding to another of said split fields, further comprising circuitry for applying said positive and negative data pulses alternately at time intervals of one fourth of a time period of the sustain signal in synchronization with the scan signal.

17. The system as defined in claim 13, wherein said scan electrode includes means for receiving an erase signal, further comprising circuitry for applying the erase signal of a negative (−) polarity to a first set of the scan electrodes corresponding to one of said split fields, and the erase signal of a positive (+) polarity to a second set of the scan electrodes corresponding to another of said split fields.

18. The system as defined in claim 13, wherein said scan signal received by the scan electrode corresponding to the upper part of the field has a phase different than that corresponding to the lower part of the field by half a time period of the sustain signal.

19. The system as defined in claim 13, further comprising one or more common electrodes for receiving scan signals, wherein a first set of the common and scan electrodes C1 and S2 corresponding to one of said split fields are connected to a first sustain voltage source, and a second set of the common and scan electrodes corresponding to another of said split fields is connected to a second sustain voltage source which is delayed by half a period with respect to waveforms applied to the first set of the common and scan electrodes;

wherein the scan signal is inserted between the sustain signal of a pair of scan electrodes with a phase difference of half a time period of the sustain signal; and wherein two of the split fields are concurrently scanned in a period of the sustain pulse.

20. The system as defined in claim 13, wherein the data signals include a first data pulse representing one of said split fields and a second data pulse representing another of said split fields, further comprising circuitry for applying the first and second data pulses alternately at time intervals of one fourth of a time period of the sustain signal in synchronization with the scan signal.

21. The system as defined in claim 13, wherein said scan electrode includes means for receiving an erase signal, further comprising circuitry means for applying the erase signal to the scan electrode after a predetermined time after the scan signal is applied.

22. A plasma display panel, comprising:

a plurality of row electrodes divided into groups collectively corresponding to a field, each group including a plurality of scan electrodes and one or more common electrodes, said scan electrodes and common electrodes facing one another; and driving circuitry for applying a driving signal to said row electrodes of each group independently of the other group, wherein said row electrodes are divided into four groups corresponding to upper-upper, upper-lower, lower-upper, and lower-lower parts of the field, and each group arranged in an order of (S1-C1-S2-C2) and (S1'-C1'-S2'-CS'), wherein in an upper portion of the field, a first of the scan electrodes S1 faces a first of the common electrodes C1 on opposite sides and a second of the scan electrodes S2 faces a second of the common electrodes C2 on opposite sides, and wherein in an a lower portion of the field, a first of the scan electrodes S1' faces a first of the common electrodes C1' on opposite sides and a second of the scan electrodes S2' faces a second of the common electrodes C2' on opposite sides.

23. The plasma display panel as defined in claim 22, wherein said row electrodes are arranged in an order of (S1, C1) in the upper part of the field and (S2, C2) in the lower part of the field and said row electrodes are arranged in order of {(S1, C1) (C2, S2)}, {(C1, S1) (S2, C2)}, or {(C1, S1) (C2, S2)}.

24. The plasma display panel as defined in claim 22, wherein said row electrodes in the upper portion of the field are arranged in order of (S1, C1) in the upper-upper part and (S2, C2) in the upper-lower part in an order of {(S1, C1) (C2, S2)}, {(C1, S1) (S2, C2)}, or {(C1, S1) (C2, S2)}; electrodes in the lower portion of the field are arranged in order of (S1', C1') in the lower-upper part and (S2', C2') in the lower-lower part in an order of {(S1', C1') (C2', S2')}, {(C1', S1') (S2', C2')}, or {(C1', S1') (C2', S2')}.

25. A method of driving a plasma display panel having a plurality of row electrodes and a plurality of column electrodes crossing said row electrodes, the method comprising:

splitting a field into at least two split fields by dividing the row electrodes accordingly;

dividing bits representing a digital picture signal into a plurality of pairs of upper and lower bits;

scanning the lower bit and the upper bit in each pair successively in each split field; and scanning each pair successively until all of said plurality of pairs are completely scanned, wherein said dividing step further comprises dividing the upper and lower bits into four pairs of lower and upper bits as $(I_1, I_8)$, $(I_2, I_7)$, $(I_3, I_6)$, and $(I_4, I_5)$, wherein time intervals between the pairs of bits $(I_1, I_8)$, $(I_2, I_7)$, $(I_3, I_6)$, and $(I_4, I_5)$, are determined as 0, 0, $T_{NS1}$ and $T_{NS2}$, and wherein $T_{NS1}=T_A/2$; $T_{NS2}=3T_A/4$; and $T_A$ is the time required to scan all row electrodes.

26. The method as defined in claim 25, further comprising:

applying a data signal to the column electrodes; and applying a first scan signal to first and second electrodes in synchronization with the data signal representing said lower bit and to third and fourth electrodes in synchronization with the data signal representing upper bit, the first and third electrodes represents an upper split field, and the second and fourth electrodes representing a lower split field.

27. The method as defined in claim 26, further comprising applying a sustain signal to the scan electrode, wherein a phase difference between the sustain signal in the upper and lower split fields is one fourth of a time period of the sustain signal, all sustain signal in the upper split field being opposite to those in the lower split field in polarity.

28. A method of driving a plasma display panel having a plurality of row electrodes and a plurality of column electrodes crossing said row electrodes, the method comprising:

splitting a field into at least two split fields by dividing the row electrodes accordingly;

dividing bits representing a digital picture signal into a plurality of pairs of upper and lower bits;

scanning the lower bit and the upper bit in each pair successively in each split field; and scanning each pair successively until all of said plurality of pairs are completely scanned, wherein time intervals between the pairs of bits $(I_1, I_8)$, $(I_2, I_7)$, $(I_3, I_6)$, and $(I_4, I_5)$, can be determined as 0, 0, 0 and $T_{NS1}$ by prolonging the time of a discharge of the most significant bit, wherein $T_{NS1}=T_A/2$ and $T_A$ is the time required to scan all row electrodes.

* * * * *